US008381491B2

(12) United States Patent
Yuyama et al.

(10) Patent No.: US 8,381,491 B2
(45) Date of Patent: Feb. 26, 2013

(54) VIAL LID FASTENING DEVICE AND MEDICINE ACCOMMODATING AND REMOVING DEVICE

(75) Inventors: Shoji Yuyama, Toyonaka (JP); Naoki Koike, Toyonaka (JP); Takafumi Imai, Toyonaka (JP); Minoru Tano, Toyonaka (JP); Yoshinori Maeji, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 438 days.

(21) Appl. No.: 12/672,029

(22) PCT Filed: Jul. 31, 2008

(86) PCT No.: PCT/JP2008/063732

§ 371 (c)(1),
(2), (4) Date: Feb. 3, 2010

(87) PCT Pub. No.: WO2009/020032

PCT Pub. Date: Feb. 12, 2009

(65) Prior Publication Data

US 2010/0251667 A1 Oct. 7, 2010

(30) Foreign Application Priority Data

Aug. 3, 2007 (JP) ..... 2007-203668
Jul. 30, 2008 (JP) ..... 2008-196153

(51) Int. Cl.
*B67B 3/20* (2006.01)

(52) U.S. Cl. ..... 53/281; 53/478; 53/485; 53/287

(58) Field of Classification Search ..... 53/478, 53/485, 281, 284.6, 287, 317, 318, 331.5, 53/367

See application file for complete search history.

(56) References Cited

U.S. PATENT DOCUMENTS 5,819,508 A * 10/1998 Kraft et al. ..... 53/492
6,115,996 A * 9/2000 Yuyama et al. ..... 53/411
6,519,913 B2 * 2/2003 Higashizaki et al. ..... 53/75

(Continued)

FOREIGN PATENT DOCUMENTS

JP 63-116410 7/1988
JP 3-56598 5/1991

(Continued)

*Primary Examiner* — Hemant M Desai
(74) *Attorney, Agent, or Firm* — Jones Day

(57) ABSTRACT

There is provided an improved vial lid fastening device capable of reliably completing lid fastening in a short time. The vial lid fastening device 30 has a lid rotating device 51, a lid placing member 52, 53, a transporting device 55, 56, a first lid body reservoir 115, 116, a vial lid holding and supplying device 57, and a vial discharging device 58. A lid body 3 slides on an inclined flat surface 102 to reach a terminal mechanism part 101, and a stepped section 31 of the lid body 3 engages a stepped section holder 105. The lid body 3 is grasped by chuck claws 35 and is rotated as engaged to the terminal mechanism part 101 of the stepped section holder 105. Then, one of rotation regulating protrusions 28*a*, 28*b* of the lid body 3 is allowed to collide with a rotation preventing member 107 of the lid placing member 52. Thus, position determination in a rotation direction is performed with reference to the rotation regulating projections 28*a*, 28*b* and such position is maintained fixedly. Thereafter, the lid body 3 is mated with the vial body 2 and then rotated by a chuck.

20 Claims, 32 Drawing Sheets

U.S. PATENT DOCUMENTS

| | | | | |
|---|---|---|---|---|
| 7,082,739 | B2 * | 8/2006 | Guernieri et al. | 53/367 |
| 7,581,373 | B2 * | 9/2009 | Sink et al. | 53/485 |
| 7,596,932 | B2 * | 10/2009 | Sink et al. | 53/485 |
| 2006/0243738 | A1 | 11/2006 | Yuyama | |
| 2008/0168751 | A1 * | 7/2008 | Sink et al. | 53/490 |
| 2008/0223815 | A1 * | 9/2008 | Konrad | 215/329 |
| 2009/0013642 | A1 | 1/2009 | Yuyama | |
| 2009/0025346 | A1 * | 1/2009 | Sink et al. | 53/490 |
| 2010/0058711 | A1 * | 3/2010 | Blumenstock et al. | 53/64 |

FOREIGN PATENT DOCUMENTS

| | | | |
|---|---|---|---|
| JP | 2005211519 | A | 8/2005 |
| JP | 2005343521 | A | 12/2005 |
| JP | 2006240738 | A | 9/2006 |
| WO | WO 2005/011563 | A1 | 2/2005 |

* cited by examiner (a)

(b)

(c)

VIAL LID FASTENING DEVICE AND MEDICINE ACCOMMODATING AND REMOVING DEVICE

CROSS-REFERENCE TO RELATED APPLICATIONS

This application is a national stage filing under 35 U.S.C §371 of International Patent Application No. PCT/JP2008/063732, filed Jul. 31, 2008, the entire contents of which are incorporated by reference herein; claims the benefit of Japanese Patent Application No. 2007-203668, filed Aug. 3, 2007, the entire contents of which are incorporated by reference herein; and also claims the benefit of Japanese Patent Application No. 2008-196153, filed Jul. 30, 2008, the entire contents of which are incorporated by reference herein.

TECHNICAL FIELD

The present invention relates to a device for automatically mounting a lid to a body of a vial filled with tablets.

BACKGROUND ART

Vials are containers with a lid for accommodating solid medicines such as tablets, capsulated drugs, etc. In hospitals or drugstores, vials filled with tablets customized according to patients are delivered to such patients or their attendants. Conventionally, the task of filling vials with tablets is manually done by pharmacists. That is, the pharmacist selects one medicine among different types of stocked medicines according to prescription, counts the quantity of the selected medicine and fills a vial with the selected medicine. Then, the pharmacist seals the vial and hands over the same to patients.

However, such task of manually selecting the medicine and filling the vial requires much work and is thus burdensome. In this regard, Patent Document 1 suggests a medicine accommodating and removing device, which automatically performs serial operations from selecting a medicine to filling a vial. Further, Patent Document 2 discloses a device for capping a vial, which is used as a part of the medicine accommodating and removing device.

Patent Document 1: International Laid-Open Patent Application No. WO2005/011563

Patent Document 2: Japanese Laid-Open Patent Application No. 2006-240738

The device disclosed in Patent Document 2 is configured to be used for a vial with a lid having threads on the outside and inside of the lid. According to the device disclosed in Patent Document 2, the lid is held by the outside thread and is rotated while being pressed against the vial body, thereby fastening the lid to the vial body.

Further, vials including a lock mechanism for preventing children from taking medicines are already known in the art. The device disclosed in Patent Document 2 also discloses an example of such a lock mechanism. The lock mechanism disclosed in Patent Document 2 is configured so that a protrusion that regulates rotation is provided on an inside portion of a lid and a claw of a vial body engages the protrusion. According to the vial disclosed in Patent Document 2, if the lid is rotated and the thread reaches a terminal end, then the protrusion of the lid climbs over the claw to lock the lid.

SUMMARY OF THE INVENTION

The vial lid fastening device disclosed in Patent Document 2 is capable of automatically closing the lid of the vial, thereby greatly contributing to automating the work to be done in drugstores. However, the relevant art requires faster and more efficient serial processes from selecting a medicine to fastening a lid. Further, when the lid is fastened to the vial body, the threads of both may not mesh well with each other, and thus, the lid may be askew after being closed. Thus, in light of the aforementioned demand in the art and the foregoing problems, it is an object of the present invention to improve lid fastening devices for vials to provide a device that can reliably fasten a lid in a shorter time.

In order to accomplish the above objects, the inventors investigated whether or not the known lid fastening device has vain operations. By doing so, it was ascertained that there was considerable unevenness in the time spent from putting a lid to an opening of a vial to completing lid fastening. Specifically, when using a vial with a structure described in Patent Document 2, the vial with its lid locked thereto must be handed over to a patient. Thus, lid fastening must be performed until the thread reaches its terminal end.

Since a vial is a plastic-molded product, its threads are not uneven along the total length. Accordingly, a rotation angle (thread-engagement angle) is not uneven until the thread of the lid reaches a terminal end of the thread of the vial body. More specifically, the rotation angle is not uneven until a beginning end of the thread of the lid and a beginning end of the thread of the vial body become in contact with each other, wherein the lid fastening is then completed. However, there is considerable unevenness between a position in the rotation angle (a position in a rotation direction relative to a central axis) of the beginning end of the thread of the lid and a position in a rotation direction of the beginning end of the thread of the vial body when the lid is applied to an opening of the vial body. That is, when the lid is put into the opening of the vial, a distance between the beginning end of the thread of the lid and the beginning end of the thread of the vial body varies. That is, they both may be close to or distant from each other. Thus, when they are both distant from each other, a considerable rotation angle is required until the beginning end of the thread of the lid is brought in contact with the beginning end of the thread of the vial body, thereby lengthening the time to be spent for fastening the lid. Further, the threads may be engaged with each other with misalignment therebetween. Thus, the lid fastening tends to be unstable.

Accordingly, the inventors have devised measures for uniting a position in a rotation direction of a lid body and a position in a rotation direction of the vial body when the lid body comes in contact with the vial body. This reduces the time to be spent from putting a lid into an opening of a vial body of a vial to fasten the lid to the vial, and further reliably fasten the lid.

The invention recited in Claim 1, which has been devised based on the above measures, is a vial lid fastening device for targeting a vial having a vial body and a lid body and mounting the lid body to the vial body, wherein the targeted vial includes threads engaging each other at the vial body and the lid body and the lid body includes a rotation regulating part engaging a portion of the vial body to regulate rotation. The vial lid fastening device includes a vial body holding means for holding the vial body while maintaining a position in a rotation direction relative to a central axis; a lid holding means for bring the lid body into contact with the vial body while maintaining a position in a rotation direction relative to the central axis with reference to the rotation regulating part; and a lid rotating and fastening means for relatively rotating the lid body and the vial body.

According to the vial lid fastening device of the present invention, the vial body is held by the vial body holding means, while the position in a rotation direction of the vial body relative to the central axis is united. Further, the lid body is held as its position in a rotation direction is adjusted. The vial that the present invention targets includes the rotation regulating part, which engages a portion of the vial body to regulate the rotation, at the lid body. The lid body fastening device of the present invention fixedly maintains the position in a rotation direction of the lid body with reference to the rotation regulating part. That is, the lid body is held by the lid holding means so that stop positions in a rotating direction of the rotation regulating part are always the same. Further, the vial body is also held such that a stop position in a rotation direction of its certain portion is the same and corresponds to the stop position in a rotation direction of the rotation regulating part of the lid body. Furthermore, according to the present invention, the lid holding means brings the lid body into contact with the vial body and the lid rotating and fastening means rotates the lid body and the vial body relative to each other. Thus, if the lid body and the vial body are rotated only at a certain angle, then the thread of the lid body and the thread of the vial body are allowed to contact each other. Also, if further rotated only at another certain angle, then the threads are engaged to each other. Thus, according to the present invention, unevenness occurs less in a rotation amount while the lid body contacts the vial body, wherein the threads are then completely engaged. Further, as the present invention is implemented, the thread of the lid body is reliably engaged to the thread of the vial body and the lid fastening can be reliably performed.

The invention recited in Claim 2 is the vial lid fastening device recited in Claim 1, wherein the lid body and the vial body are mated to each other and then are relatively rotated to fasten the lid body, and wherein a relative position in a rotation direction when the lid body and the vial body are mated to each other is such that when the lid body and the vial body are relatively rotated, a beginning end of the thread of the lid body and a beginning end of the thread of the vial body contact each other at a rotation angle of less than 15 degrees.

According to the vial lid fastening device of the present invention, when the lid body and the vial body are mated to each other, a beginning end of the thread of the vial body and a beginning end of the thread of the lid body are located closely to each other. Thus, the lid fastening can be completed at a small rotation angle. That is, if both of them are brought into contact with (or mated with) each other and then rotated relatively, the threads provided in both of them respectively begin to directly thread-engage each other and the lid fastening can be completed fast. Further, since both of the threads firmly engage each other, the lid body can be prevented from being fastened askew.

The invention recited in Claim 3 is the vial lid fastening device recited in Claim 1 or 2, which further includes a lid placing part configured to rotatably place the lid body; a rotation preventing member configured to contact the rotation regulating part in a predetermined rotation position; and a rotating and positioning means for rotating the lid body with a torque of a predetermined range.

According to the vial lid fastening device of the present invention, the lid placing part holds the lid body and rotates the lid body as it is held, thereby determining the position of the lid body. Further, since the rotation preventing member is included in the present invention, when the lid body is in a predetermined rotating position, the rotation regulating part of the lid body is allowed to contact the rotation preventing member. Thus, if the lid body is rotated with a torque of a certain range, then the lid body stops as the rotating regulating part contacts the rotation preventing member. Therefore, the position in a rotation direction of the lid body relative to the central axis is united relative to the central axis. Accordingly, the lid body is firmly fastened to the vial body. Further, as for a means for rotating the lid body with a torque of a certain range, it may be considered that a torque limiter stops the rotation of the member for rotating the lid body when a torque is applied beyond the predetermined range, or that a chuck grasps and rotates the lid body with a certain force and as a torque rises, the chuck slips to cut off a power transmission to the lid body.

The invention recited in Claim 4 is the vial lid fastening device recited in Claim 3, wherein the rotating and fastening means combines the rotating and positioning means and has a chucking function for grasping the lid body, a lifting and lowering function and a tilting function, wherein the lid body of the targeted vial has a stepped section and the lid placing part includes an inclined placing surface and a stepped section holder, wherein the lid body slides down the placing surface and the stepped section holder engages the stepped section of the lid body in a position where the lid body slides down and then stops to prevent the lid body from floating upward, and wherein the rotating and fastening means grasps the lid body by the chucking function and rotates the lid body then tilts the lid body to move the lid body up in an inclined direction in order to disengage the lid body from the stepped section holder.

According to the vial lid fastening device of the present invention, the rotating and positioning means and the rotating and fastening means are combined. Thus, the vial lid fastening device of the present invention has a small number of parts. Further, when the lid body is rotated, the stepped section holder engages the stepped section of the lid body to prevent the lid body from floating upward. Thus, if the lid body is rotated and reaches a predetermined rotation position, then the rotation regulating part of the lid body firmly contacts the rotation preventing member. As a result, the rotation of the lid body stops and position determination (positioning in a rotating direction) is made accordingly. Further, according to the present invention, since tilting the lid rotating and fastening means allows the lid body to move up in an inclined direction to thereby release engagement to the stepped section holder, vain operations do not exist.

The invention recited in Claim 5 is the vial lid fastening device recited in Claim 3 or 4, wherein the lid body of the targeted vial has a concave portion and the thread and the rotation regulating part are situated on an inner periphery of the concave portion, and wherein the lid body is held on the lid placing part with the concave portion lying prone and the rotation preventing member protrudes toward and is retracted from the concave portion of the lid body at the placing surface of the lid placing part.

According to the vial lid fastening device of the present invention, the lid body is placed on the lid placing member with the concave portion lying prone. And, the rotation preventing member protrudes toward and is retracted from the inside of the concave portion. Thus, the rotation preventing member can be retracted from the placing surface when the lid body is placed on the lid placing part and slides down to the stepped section holder, whereas it can protrude from the placing surface when the lid body is held by the stepped section holder.

The invention recited in Claim 6 is the vial lid fastening device recited in any one of Claims 3 to 5, which further comprises a first lid body sensor for detecting whether the lid body is situated on the lid placing part.

According to the vial lid fastening device of the present invention, the first lid body sensor detects whether the lid body is placed on the lid positioning part or not. Thus, the status of supplying the lid body can be monitored.

The invention recited in Claim 7 is the vial lid fastening device recited in Claim 6, wherein the first lid body sensor is configured to distinguish a lid body of a diameter larger than a predetermined dimension and a lid body of a diameter smaller than the predetermined dimension.

According to the vial lid fastening device of the present invention, since the lid body of a diameter larger than the predetermined dimension and the lid body of a diameter smaller than the predetermined dimension can be distinguished, it can be determined whether a lid body having a dimension other than that of a given lid body corresponding to the vial body has been mingled together. Accordingly, the occurrence of faulty lid fastening can be prevented.

The invention recited in Claim 8 is the vial lid fastening device recited in Claim 6 or 7, wherein the first lid body sensor includes a plurality of sensors.

According to the vial lid fastening device of the present invention, since the first lid body sensor includes a plurality of sensors, the plurality of sensors simultaneously detect the lid body at a plurality of places. Therefore, detection precision for the lid body is enhanced. Further, it can be detected that a lid body smaller than the predetermined dimension corresponding to the vial body mingles together. Thus, the occurrence of faulty lid fastening can be prevented.

The invention recited in Claim 9 is the vial lid fastening device recited in any one of Claims 1 to 8, wherein the lid body of the targeted vial has an exterior contour of a stepped shape, whereby the lid body includes a larger-diameter section and a smaller-diameter section, wherein the smaller-diameter section has a threaded portion with the thread provided thereon and a flat-surfaced portion, and wherein the lid rotating and fastening means has a chuck part with three or more holding claws that grasp the flat-surfaced portion.

According to the vial lid fastening device of the present invention, the lid body is held in such a manner that the holding claws grasp the flat-surfaced portion. Thus, the lid body can be held in a stable manner.

The invention recited in Claim 10 is the vial lid fastening device recited in Claim 9, wherein a projecting part that limits a dimension for permitting the lid body to pass therethrough is provided at the lid placing part with a predetermined height, and wherein the dimension is larger than a diameter of the smaller-diameter section of the lid body and smaller than a diameter of the larger-diameter section of the lid body.

According to the vial lid fastening device of the present invention, when the lid body having the larger-diameter section, the smaller-diameter section is placed on the lid placing part as its top and bottom face a reverse direction, the projecting part collides with the larger-diameter section to hinder the lid body from passing therethrough. Thus, faulty lid fastening, which occurs when the lid body is placed on the lid positioning part as its top and bottom face a reverse direction, can be prevented.

The invention recited in Claim 11 is the vial lid fastening device recited in any one of Claims 1 to 10, which further includes a first lid body reservoir configured to stock the lid body; a second lid body reservoir in a middle of a conveyance path wherein the lid body is conveyed from the first lid body reservoir to a predetermined location; a first conveyor for conveying the lid body from the first lid body reservoir to the second lid body reservoir; and a second conveyor for conveying the lid body from the second lid body reservoir to the predetermined location, wherein the first conveyor is configured to remove the lid body out of the first conveyor and convey the lid body one by one and the second conveyor is configured to adjust an inside and outside position of the lid body and convey the lid body to the predetermined location.

According to the vial lid fastening device of the present invention, the first vial lid reservoir for stocking the lid bodies is provided. According to the vial lid fastening device of the present invention, the lid bodies before use are fed into the first lid body reservoir and stocked in the first lid body reservoir. In such a case, the lid bodies are randomly situated in the first lid body reservoir and can piled into a heap. And, the lid bodies are removed one by one from the first lid body reservoir by the first conveyor. Thus, entangled lid bodies become disentangled and the lid bodies are allowed to enter the second lid body reservoir one by one as they are completely separated. Subsequently, the lid body is conveyed by the second conveyor and during such conveyance an inside and outside position of the lid body is adjusted. Thus, after the lid body passes by the second conveyor, the inside and outside position of the lid body is arranged.

The vial lid fastening device of Claim 12 is the vial lid fastening device recited in Claim 11, wherein the second conveyor includes a sharp inclination section, whereby the lid body takes an erected position at the sharp inclination section and the lid body without a normal inside and outside position falls off.

According to the vial lid fastening device of the present invention, the second conveyor includes the sharp inclination section and the lid body takes an erected position thereby. The lid body of the vial inherently has an open side and a closed side or a portion that enters a vial body and a portion that protrudes outwardly from the vial body. Thus, when it is held erect, it tilts toward one side. According to the vial lid fastening device of the present invention, the sharp inclination section has the lid body stand erect. Thus, the erected lid body becomes tilted toward one side. Thus, the lid body that is not situated in a normal position falls off the second conveyor due to the tilting of the lid.

The invention recited in Claim 13 is the vial lid fastening device recited in Claim 11 or 12, which further includes a second lid body sensor for detecting a quantity of the lid body stocked in the first lid body reservoir.

According to the vial lid fastening device of the present invention, the second lid body sensor detects the quantity of the lid bodies in the first lid body reservoir. Thus, delay of the lid fastening operation, which may be caused by insufficiency of the lid bodies, can be prevented.

The invention recited in Claim 14 is the vial lid fastening device recited in Claim 13, wherein the second lid body sensor detects whether a remainder of the lid body exceeds a predetermined quantity and/or whether a remainder of the lid body is below the predetermined quantity.

According to the vial lid fastening device of the present invention, by detecting whether the remainder of the lid bodies exceeds a predetermined quantity and/or whether the remainder of the lid bodies is below the predetermined quantity, the quantity of the lid bodies in the first lid body reservoir can be maintained within a predetermined range. Thus, catch, jam, pinch, etc., which occurs at any portion of the device due to the excessive quantity of the vial bodies, can be prevented. Or, the stoppage of the lid fastening operation, which results from no vial bodies, can be prevented in advance.

The invention recited in Claim 15 is the vial lid fastening device recited in any one of Claims 1 to 14, which further includes a conveyor configured to move the lid body to a predetermined position. The conveyor includes an erected section for holding and lifting the lid body situated at a bottom side; and a section having an angle of 80 degrees to 100 degrees relative to a horizontal plane at least a portion of the erected section.

In this case, the angle of 80 degrees to 100 degrees means angles upwardly inclined relative to a horizontal plane. As the angle becomes an acute angle, the inclination becomes gentle. As the angle becomes close to 90 degrees, the inclination becomes sharp. If the angle exceeds 90 degrees, the inclination is in an overhang state. According to the vial lid fastening device of the present invention, the conveyor includes an erected section for holding and lifting the lid body situated at a bottom side. And, a section having an angle of 80 degrees to 100 degrees relative to a horizontal plane is provided at least a portion of the erected section. According to the vial lid fastening device of the present invention, the inside and outside position of the vial body is adjusted through the erected section. As discussed above, when the lid body is held erect, it tilts toward one side. According to the vial lid fastening device of the present invention, since the conveyor has the erected section having a sharp inclination or an almost overhang shape, the lid body is allowed to tilt toward one side in the erected section. Thus, the lid body that is not in the normal position can be eliminated by means of such tilt.

The invention recited in Claim 16 is the vial lid fastening device recited in any one of Claims 1 to 15, which further includes a third lid body sensor for detecting whether the lid holding means holds the lid body.

According to the vial lid fastening device of the present invention, since the third lid body sensor detects when the lid holding means holds the lid body, the lid fastening operation is smoothly performed. That is, if the lid body is not held when the lid holding means must hold the lid body, it can fall off. Accordingly, it can be prevented that such a fallen lid body causes a catch, jam, pinch, etc. at any portion of the device.

The invention recited in Claim 17 is a medicine accommodating and removing device, which includes a vial body accommodating section configured to accommodate vial bodies of vials; a medicine stocking section configured to stock different kinds of medicines; a medicine dispensing means configured to dispense a desired medicine out of the medicine stocking section; and a vial lid fastening device according to any one of Claims 1 to 16.

According to the medicine accommodating and removing device of present invention, the vial can be filled with desired medicines in a short time.

BRIEF DESCRIPTION OF THE DRAWINGS

FIGS. 6(*a*), 6(*b*) and 6(*c*) illustrate a state before engagement, a state during engagement, and a state after engagement, respectively.

FIG. 22(*b*) is a sectioned front view of the terminal portion of the lid placing member with the lid body placed thereon. FIGS. 22(*a*) and 22(*b*) illustrate that a rotation preventing member does not protrude from an inclined flat surface and the rotation regulating protrusions are separated from the rotation preventing member.

FIG. 23(*b*) is a sectioned front view of the terminal portion of the lid placing member with the lid body placed thereon. FIGS. 23(*a*) and 23(*b*) illustrate that the rotation preventing member protrudes from the inclined flat surface from a state illustrated in FIG. 22.

FIG. 24(*b*) is a sectioned front view of the terminal portion of the lid placing member with the lid body placed thereon. FIGS. 24(*a*) and 24(*b*) illustrate that the lid body is rotated and the rotation regulating member of the lid body contacts the rotation preventing member to stop the rotation of the lid body from a state illustrated in FIG. 23.

FIG. 25(*b*) is a sectioned front view of the terminal portion of the lid placing member with the lid body placed thereon. FIGS. 25(*a*) and 25(*b*) illustrate that a position (rotation position) of the lid body is determined and the rotation preventing member is retracted from the inclined flat surface from a state illustrated in FIG. 24.

FIG. 26(*b*) is a sectioned front view of the terminal portion of the lid placing member with the lid body placed thereon. FIGS. 26(*a*) and 26(*b*) illustrate that the lid body is moved on the inclined flat surface upwardly of its inclination and then is removed from the lid placing member from a state illustrated in FIG. 25.

FIG. 31(*b*) is a partial side view of the inclined slide with a portion thereof broken away wherein the lid body of a larger diameter is placed thereon. FIG. 31(*c*) is a partial side view of the inclined slide with a portion thereof broken away wherein the lid body of a smaller diameter is placed thereon.

FIG. 32(*b*) is a perspective view of the inclined slide wherein the lid body is placed with its top and bottom facing a reverse direction.

DESCRIPTION OF REFERENCE NUMERALS

Figure 1:
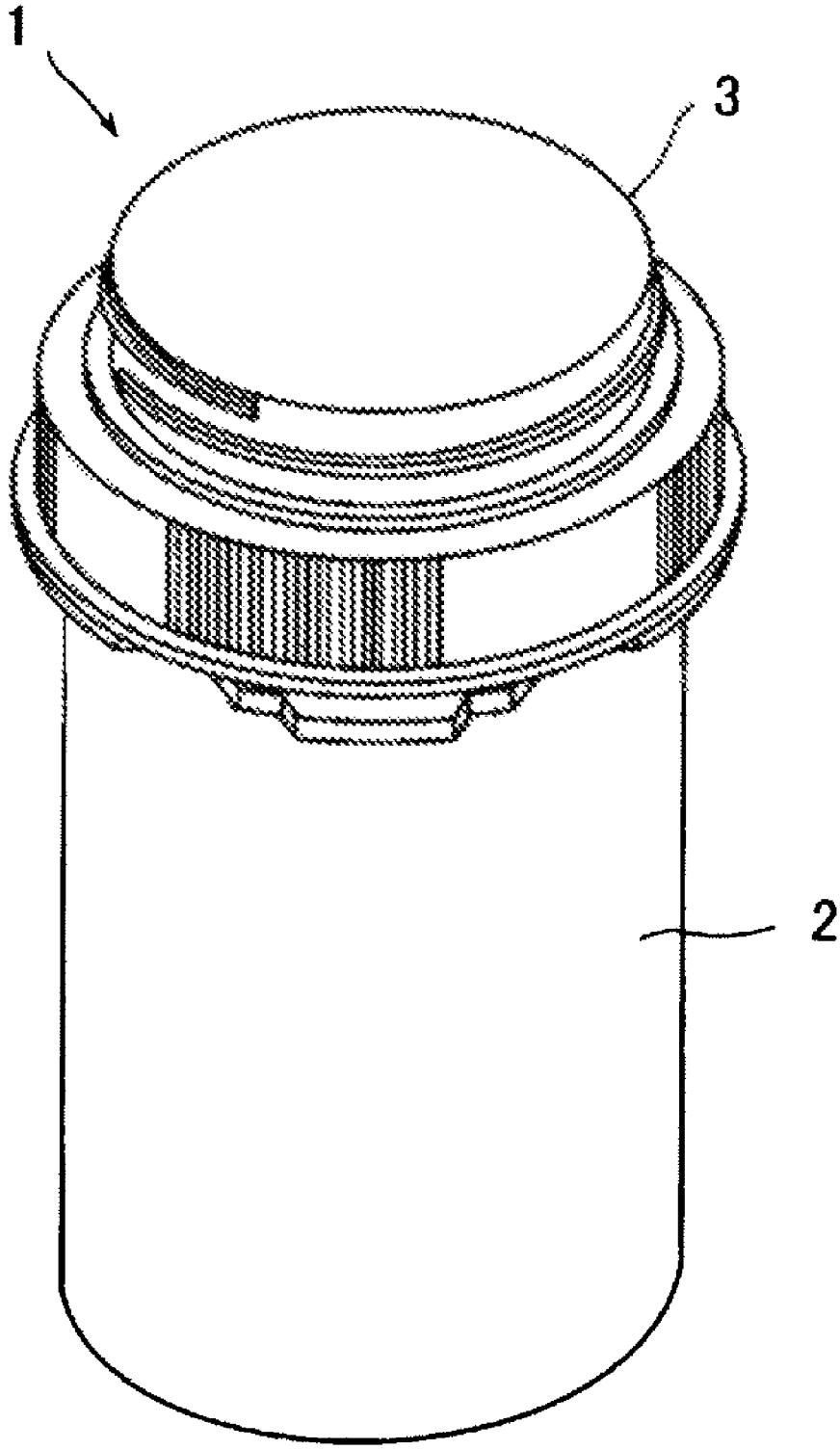
FIG. 1 is a perspective view of a vial used in a medicine accommodating and removing device of the present invention, showing the vial with a lid mounted and locked thereto.

1 Vial
2 Vial body
3 Lid body
6 Outer peripheral thread of vial
7 Inner peripheral thread of vial
11 Engaging claw
18 Projection
20 Larger-diameter section of lid body
21 Smaller-diameter section of lid body
22 Extended-diameter section of lid body
25 Inner peripheral thread of lid
26 Outer peripheral thread of lid
27 Flat-surfaced portion
28*a*, 28*b* Rotation regulating protrusion (Rotation regulating part)
29 Small stepped section
30 Vial lid fastening device
31 Stepped section
35 Chuck claw (lid holding means)
51 Lid rotating device (lid rotating and fastening means)
52, 53 Lid placing member
55, 56 Transporting device
57 Vial body holding and supplying device (vial body holding means)
58 Vial discharging device
115, 116 First lid body reservoir
117 Second lid body reservoir
136 Erected section (sharp inclination section)
200 Medicine accommodating and removing device
Y-Y Central axis

DETAILED DESCRIPTION

Figure 2:
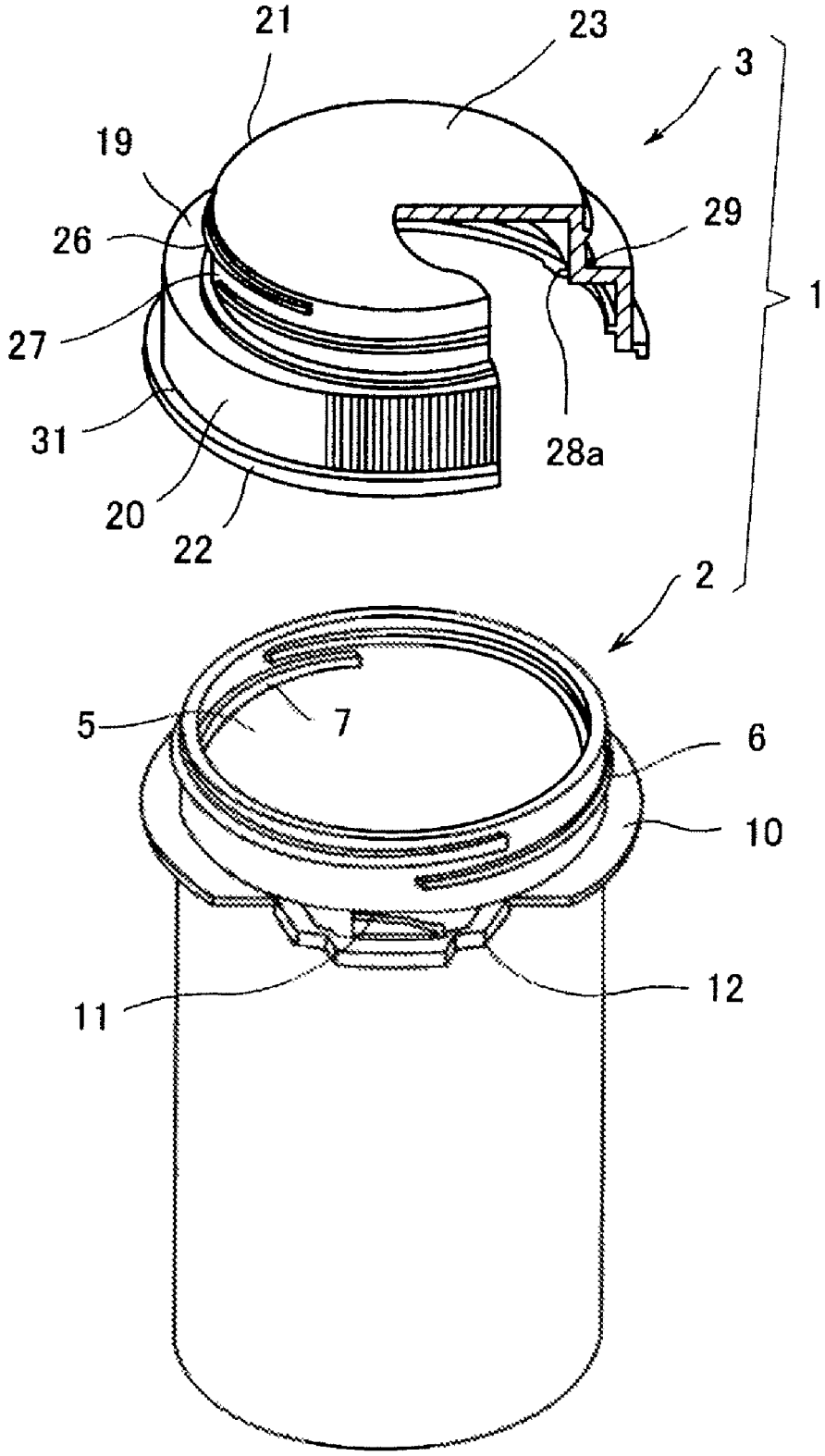
FIG. 2 is a partial cutaway perspective view of the vial shown in FIG. 1 with the lid removed therefrom.
Figure 3:
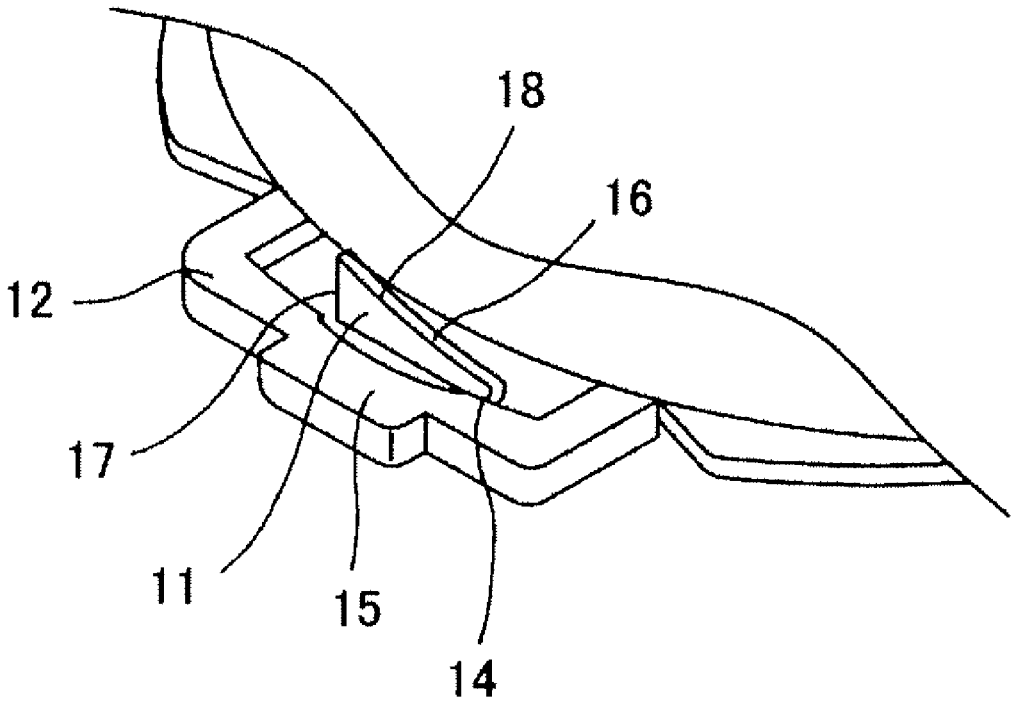
FIG. 3 is an enlarged perspective view of an engaging claw of the vial shown in FIG. 1.
Figure 4:
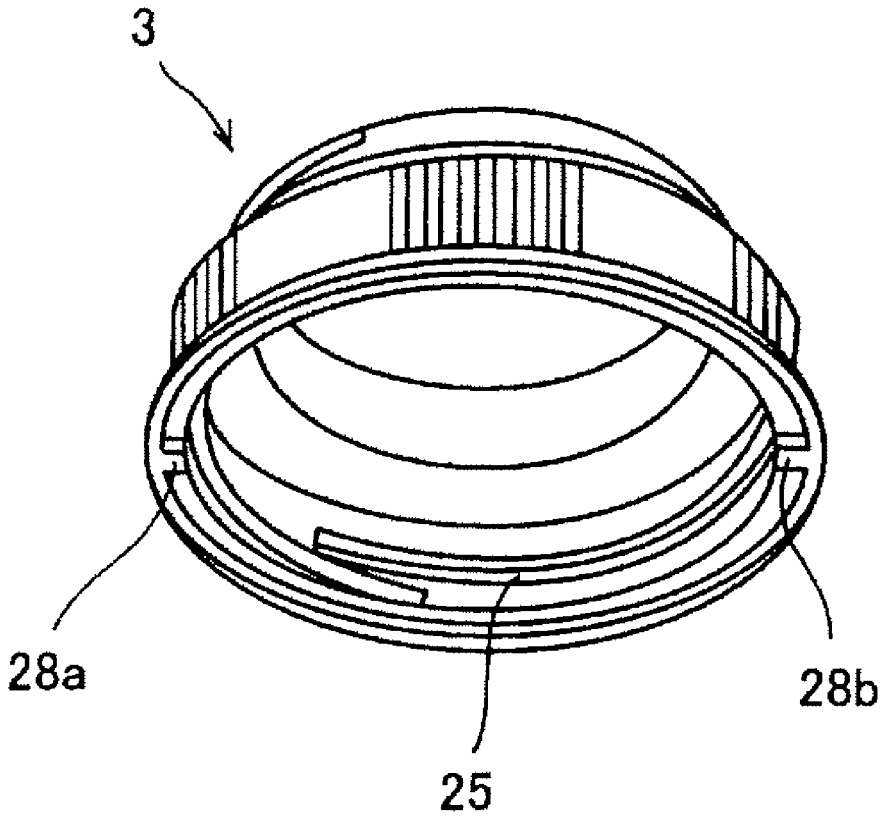
FIG. 4 is a lower perspective view of the vial shown in FIG. 1.
Figure 5:
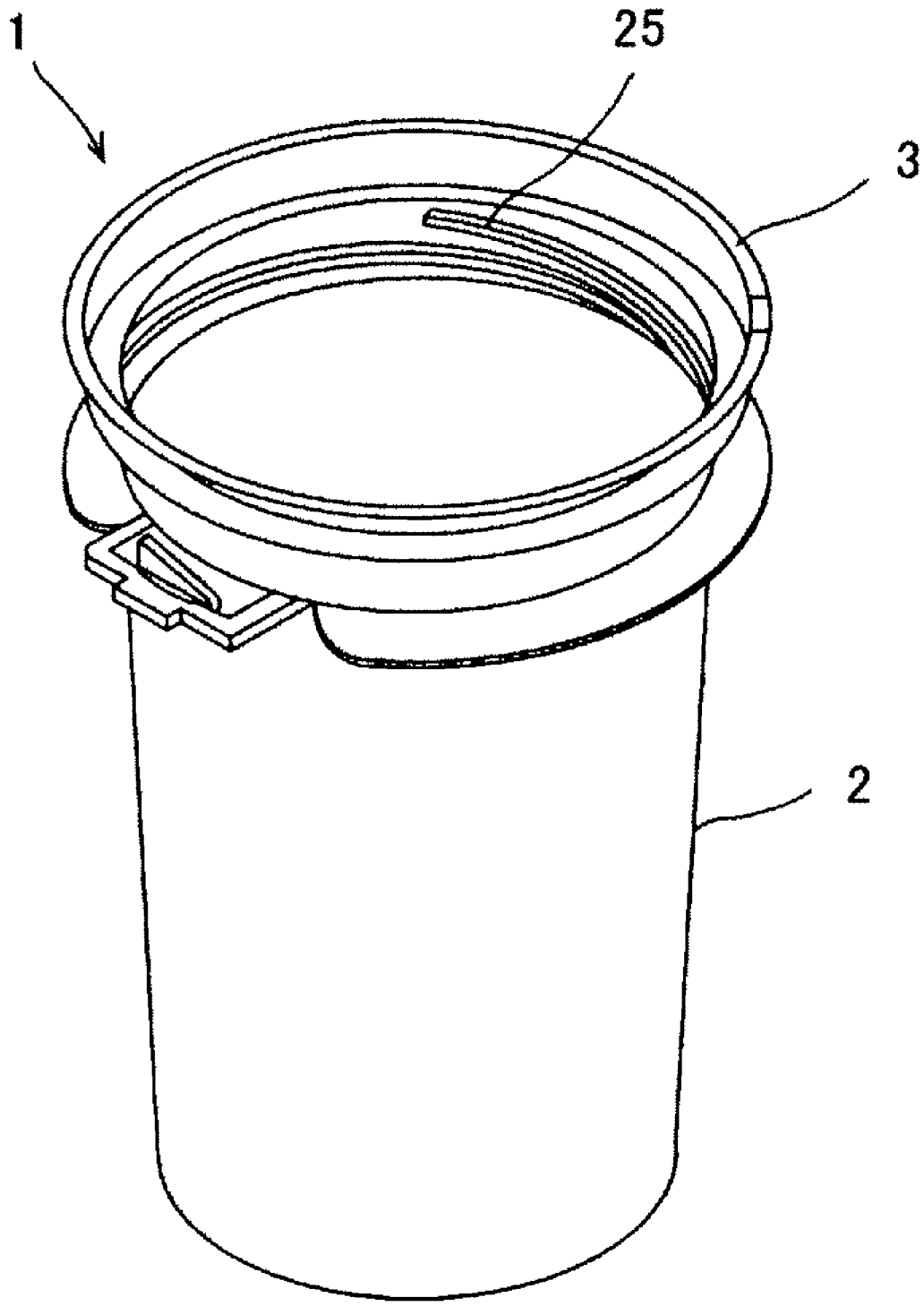
FIG. 5 is a perspective view of the vial shown in FIG. 1 with the lid upside down mounted thereto.

Embodiments of the present invention will be described below. Embodiments of the present invention are related to a medicine accommodating and removing device including a vial lid fastening device. The structure of a vial for use with the devices will be described prior to describing the devices. FIG. 1 is a perspective view of a vial that is used in the medicine accommodating and removing device of the present invention, showing that a lid is mounted and locked to the vial. FIG. 2 is a partial cutaway perspective view of the vial shown in FIG. 1 with the lid removed therefrom. FIG. 3 is an enlarged perspective view of the vial shown in FIG. 1, showing its portion with an engaging claw. FIG. 4 is a lower perspective view of the lid of the vial shown in FIG. 1. FIG. 5 is a perspective view of the vial shown in FIG. 1, showing an upside down lid mounted to a vial body.

As shown in FIG. 1, a vial 1 includes a vial body 2 and a lid body 3. Both of the vial body 2 and the lid body 3 may be fabricated from a plastic material by injection molding. The lid body 3 is mounted to an opening of the vial body 2. Mounting the lid body 3 allows the vial body 2 to be sealed.

As shown in FIG. 2, the vial body 2 has a generally cylindrical shape, i.e., a container with a closed bottom and periphery, and an open top. Threads are provided at both the inner peripheral surface and outer peripheral surface of the opening 5 of the vial body 2. That is, an outer peripheral thread of vial 6 is provided on an outer surface of the vial body 2 adjacent to the opening 5, whereas an inner peripheral thread of vial 7 is provided on an inner surface of the vial body adjacent to the opening. Further, a flange 10 is provided on the outer surface of the vial body 2 adjacent to the opening 5. The flange 10 is partly cut away. An engaging claw 11 is provided in a cut away portion of the flange. As shown in FIG. 3, an end connection 14 that is a base portion of the engaging claw 11 is connected to a holding frame 12 adjoining the flange 10. In other words, the engaging claw 11 is supported by the holding frame 12 on one side. The engaging claw 11 can be moved downward in FIG. 3 by flexing the holding frame 12.

The holding frame 12 has a U-shape when viewed vertically. Its two projecting end portions adjoin an outer periphery of the vial body 2. Further, a narrow pressing portion 15 is provided outwardly of the holding frame 12. Since the holding frame 12 is connected to the vial body 2 on a single side, pressing the pressing portion 15 downward in FIG. 3 allows the holding frame 12 to flex. The engaging claw 11 is supported by the holding frame 12 on one side as described above. Thus, it can easily flex by pressing its free end. A projection 18, which projects upward in a triangular shape when viewed horizontally, is formed at a leading end of the engaging claw 11. The projection 18 has a gentle inclined surface 16 and a vertical surface 17. The projection 18 normally projects upwardly in FIG. 3 over the holding frame 12.

The lid body 3 is fabricated from a thin plastic material to have a concave shape. When observing an exterior contour of the lid body 3 as it lies prone, it has a four-stepped structure as shown in FIGS. 1 and 2. Specifically, the lid body 3 includes: a larger-diameter section 20; a smaller-diameter section 21; and an extended-diameter section 22 at its open end. A large-stepped section 19 having a lager area exists between the larger-diameter section 20 and the smaller-diameter section 21. A stepped section 31 exists between the extended-diameter section 22 and the larger-diameter section 20. The extended-diameter section 22 forms the open end of the lid body 3 and has the largest outer diameter and the lowest height.

The larger-diameter section 20 is connected to the extended-diameter section 22 via the stepped section 31. An inner diameter of the larger-diameter section is slightly larger than an outer diameter of the opening 5 of the vial body 2. The smaller-diameter section 21 connects the large-stepped section 19 and a top surface 23. An outer diameter of the smaller-diameter section is smaller than an inner diameter of the opening 5 of the vial body 2. Further, in the vial 1 employed in this embodiment, a small-stepped section 29 is located at the intersection between the smaller-diameter section 21 and the large-stepped section 19.

Similar to the vial body 2, two sets of threads are provided in the lid body 3 of the vial 1 according to this embodiment. Specifically, as shown in FIG. 4, an inner peripheral thread of lid 25 is provided at an inner surface of the larger-diameter section 20 of the lid body 3. Further, as shown in FIGS. 1 and 2, an outer peripheral thread of lid 26 is provided at an outer periphery of the smaller-diameter section 21 of the lid body 3. The outer peripheral thread of lid 26 is located at a protruding portion of the smaller-diameter section 21. Thus, no thread exists at a base portion of the smaller-diameter section 21. That is, a flat-surfaced portion exists at the base portion of the smaller-diameter section 21. More specifically, a flat-surfaced portion 27 exists between the small-stepped section 29 and the outer peripheral thread of lid 26 in the smaller-diameter section 21 of the lid body 3.

Further, in this embodiment, as shown in FIG. 4, rotation regulating protrusions (rotation regulating parts) 28*a*, 28*b* are provided at the inner surface of the extended-diameter section 22. The rotation regulating protrusions are small cubic-shaped protrusions. The rotation regulating protrusions 28*a*, 28*b* are spaced apart from each other by 180 degrees.

As seen from FIGS. 1 and 5, the lid body 3 may be mounted to the vial body 2 in two manners. In a first manner, as shown in FIG. 1, the lid body 3 covers the opening 5 of the vial body 2 via its concave portion. When mounting the lid body 3 according to the first manner, the inner peripheral thread of lid 25 of the lid body 3 engages (or screw-engages) the outer peripheral thread of vial 6 of the vial body 2, while one of the rotation regulating protrusions 28*a*, 28*b* of the inner peripheral thread of lid 25 engages the engaging claw 11 of the vial body. When mounting the lid body 3 according to a second manner shown in FIG. 5, the outer peripheral thread of lid 26 of the lid body 3 engages the inner peripheral thread of vial 7 of the vial body 2.

Figure 6:
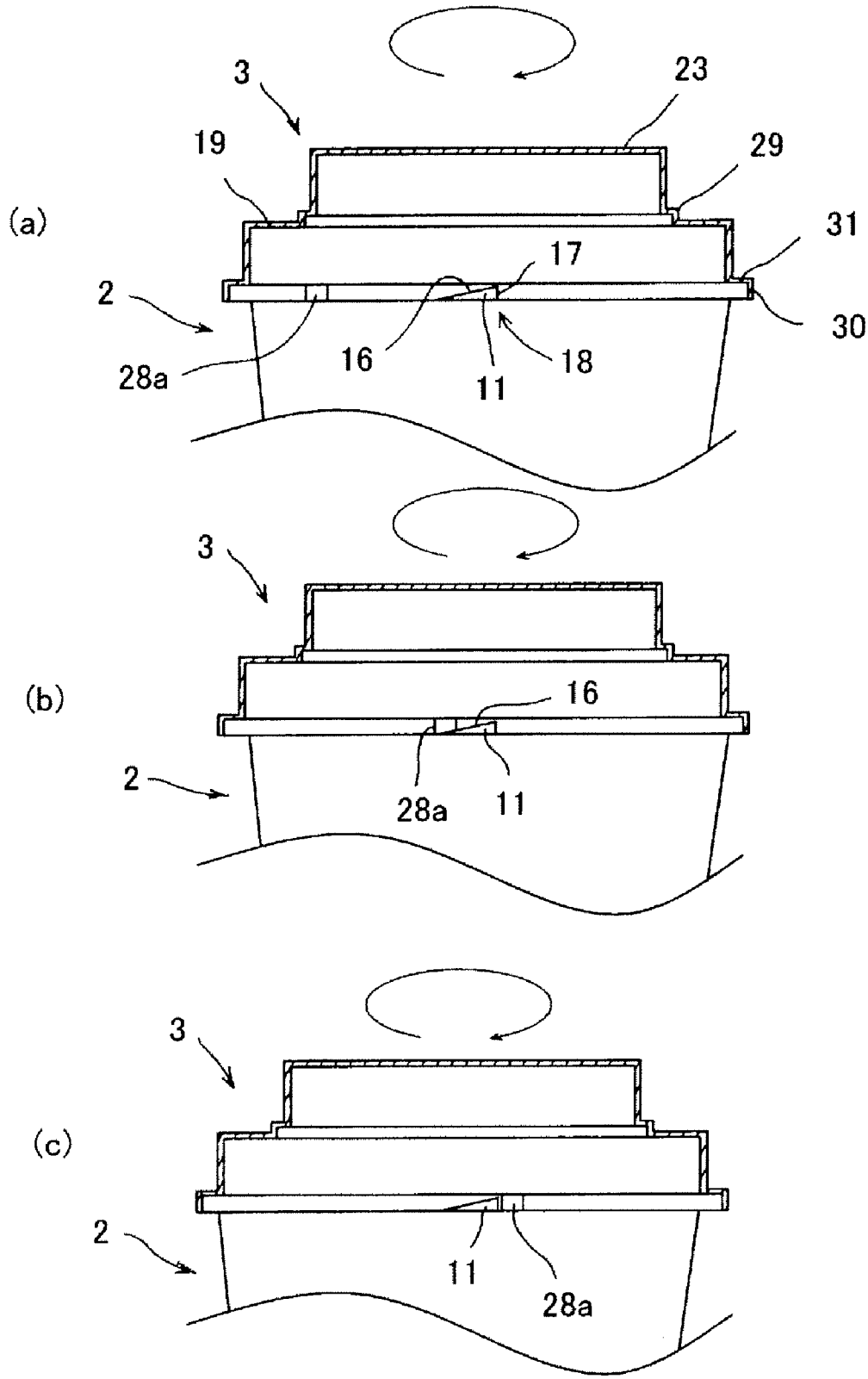
FIG. 6 illustrates that the rotation regulating protrusion engages an engaging claw of a vial body.

FIG. 6 illustrates that the rotation regulating protrusion 28*a*, 28*b* engages the engaging claw 11 of the vial body 2. FIGS. 6(*a*), 6(*b*) and 6(*c*) illustrate a state before engagement, a state during engagement, and a state after engagement, respectively. That is, as the lid body 3 is placed on the vial body 2 and is then rotated, one of the rotation regulating protrusions 28*a*, 28*b* of the lid body 3 approaches the gentle inclined surface 16 toward the projection 18 of the engaging claw 11 of the vial body 2 and contacts the gentle inclined surface 16. Referring to FIG. 6, the rotation regulating protrusion 28*a* contacts the gentle inclined surface 16. As the lid body 3 is further rotated, the rotation regulating protrusion 28*a* rides on and ascends the gentle inclined surface 16 of the engaging claw 11. Since the rotation regulating protrusion 28*a* ascends the gentle inclined surface 16 of the engaging claw 11, a vertical component force relative to an inclined surface pushes down the engaging claw 11. Further, since the engaging claw 11 fixed to the holding frame 12 can flex since it is attached to one side, the engaging claw 11 moves downward as the rotation regulating protrusion 28*a* advances. When the lid body 3 is further rotated and passes over the engaging claw 11, the engaging claw 11 returns to its original position due to its own elasticity. In such a state, the engaging claw 11 causes rotation locking. That is, as shown in FIG. 6(*c*), the vertical surface 17 of the engaging claw 11 abuts a back side of the rotation regulating protrusion 28*a*. Thus, when the lid body 3 is rotated in a reverse direction, the projection 18 of the engaging claw 11 is not allowed to move downward and serves as an obstruction, thereby preventing the reverse rotation of the lid body 3. Further, when removing the lid body 3 from the vial body 2 of the vial 1, pushing down the pressing portion 15 (see FIG. 3) moves the engaging claw 11 downward, thereby disengaging the rotation regulating protrusion 28*a* and the projection 18 from each other. Then, the lid body 3 may be rotated in a direction loosening the lid body.

As shown in FIG. 5, the lid body 3 can be mounted to the vial body 2 in a second manner. In the second manner, a convex side of the lid body 3 may be inserted into opening 5 of the vial body 2 and the outer peripheral thread of lid 26 of the lid body 3 may engage the inner peripheral thread of vial 7 of the vial body 2. When the lid body 3 is mounted to the vial body 2 according to the second manner, locking does not occur.

Figure 7:
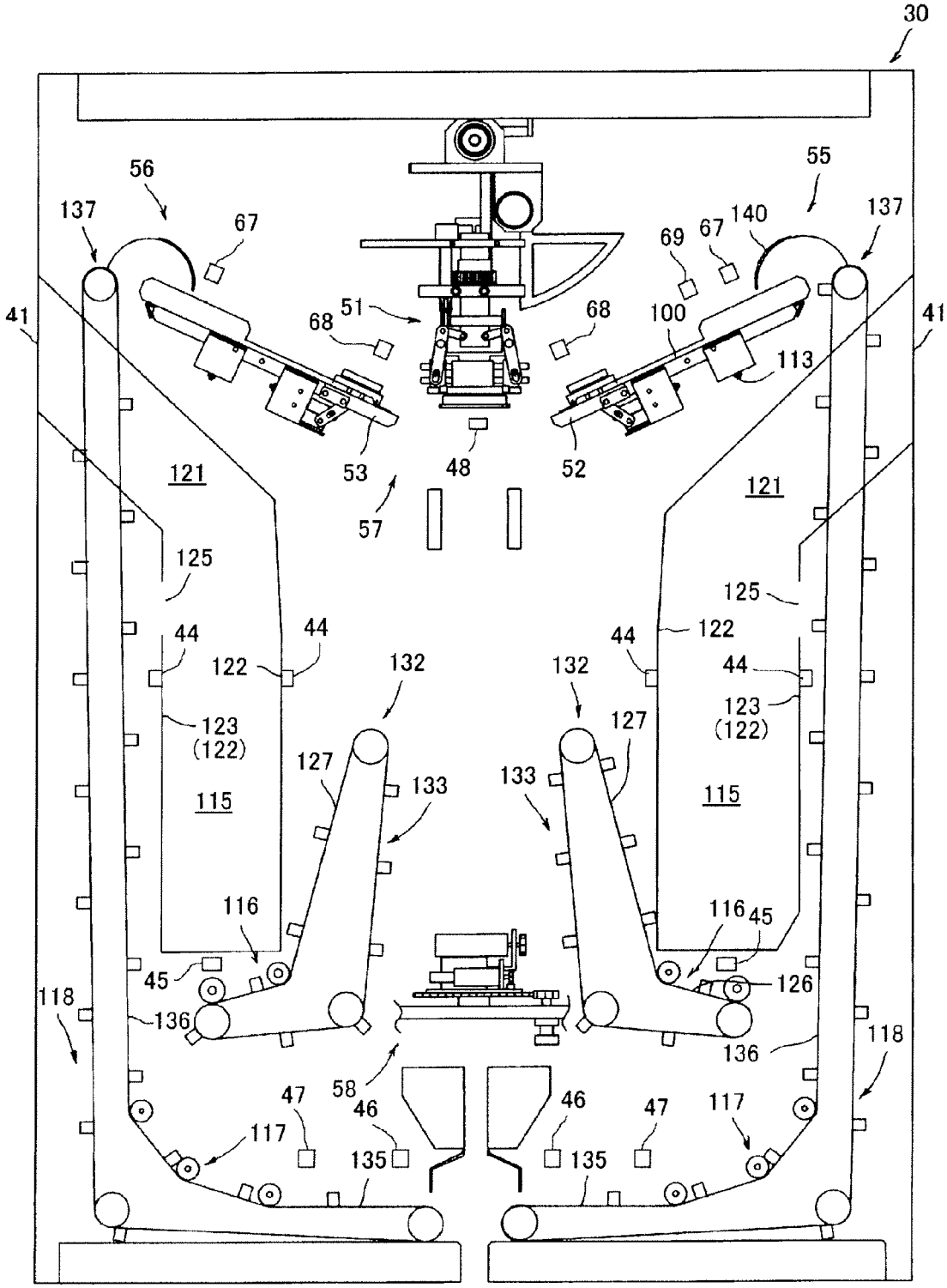
FIG. 7 is a front view of the vial lid fastening device.

Next, the vial lid fastening device according to an embodiment of the present invention will be described. The vial lid fastening device is constructed to allow vial 1 to be filled with tablets and to attach the lid body 3 to the vial in the first manner shown in FIG. 1. FIG. 7 is a front view of the vial lid fastening device according to an embodiment of the present invention. The vial lid fastening device 30 is built on an end portion of the medicine accommodating and removing device 200 that will be described below. The vial lid fastening device 30 includes the following: one set of lid rotating devices (a lid rotating and fastening means, a rotating and positioning means) 51; and two sets of lid placing members 52, 53 and transporting devices 55, 56 for transporting the lid body 3 to the lid placing members 52, 53 respectively. Also, the vial lid fastening device further includes a first lid body reservoir 115, 116, a vial body holding and supplying device 57 and a vial discharging device 58. Further, in this embodiment, a lid holding means includes the lid placing members 52, 53 and the lid rotating device 51. Hereinafter, structure of each component will be described. In describing each of the components, the terms "upper" and "lower" are based on a state wherein the vial lid fastening device 30 is installed in the medicine accommodating and removing device 200. And, the terms "forward", "backward", "left" and "right" are based on a front view shown in FIG. 7.

Figure 8:
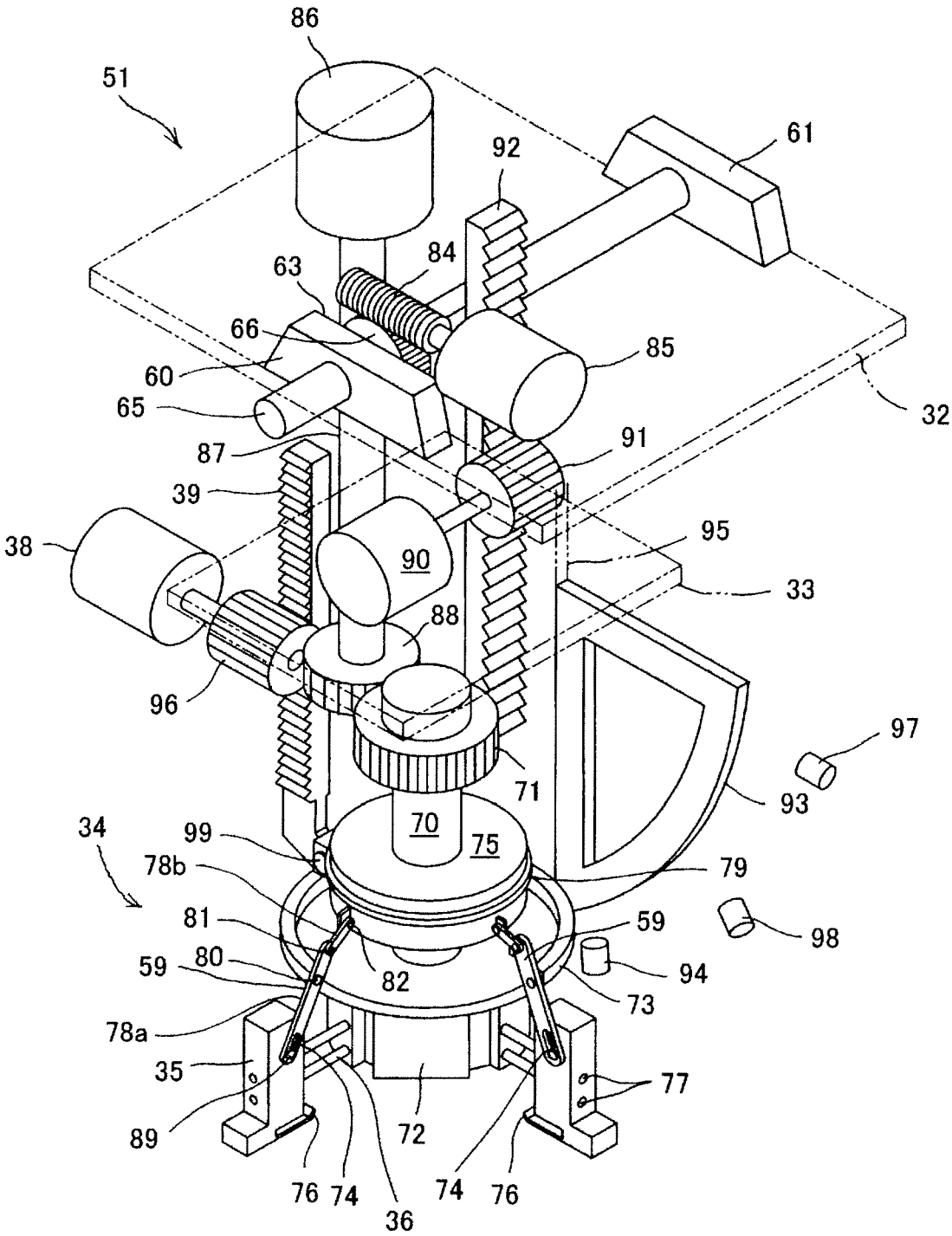
FIG. 8 is a perspective view of a lid rotating device included in the vial lid fastening device shown in FIG. 7.

FIG. 8 is a perspective view of the lid rotating device which the vial lid fastening device includes. The lid rotating device 51 has a chuck mechanism, a rotating mechanism, a mechanism for lifting and lowering the lid rotating device, and a mechanism for tilting the lid rotating device. That is, the lid rotating device 51 is configured to lift, lower and tilt the lid body 3 and further rotate the lid body 3 while grasping the lid body 3.

The lid rotating device 51 includes a tilting table 32, a lifting and lowering table 33 and a rotating device body 34. The rotating device body 34 has a rotating shaft 70 at its center. Further, the rotating device body has three chuck claws 35 and three sets of link mechanisms 59 at a lower end of the rotating shaft. The rotating shaft 70 is rotatably supported with respect to the lifting and lowering table 33 by a supporting part (not shown). A gear 71 is integrally provided near an upper end of the rotating shaft 70. Further, a guide supporter 72 is provided at the rotating shaft 70 and a fulcrum supporter 73 and a slider 75 are provided in the middle of the rotating shaft.

The guide supporter 72 is a member having a circular post shape. Guide pins 36 are radially provided on a periphery of the guide supporter. Two guide pins 36 form one set and are vertically juxtaposed parallel to each other. Further, three sets of the guide pins 36 (in total, six) are provided. Each set is disposed to be spaced apart from one another by 120 degrees.

The guide supporter 72 is integrally provided at the lower end of the rotating shaft 70 and therefore moves along with the rotating shaft 70.

The fulcrum supporter 73 has a circular post shape and is provided above the guide supporter 72. The fulcrum supporter 73 is also integrally provided at the rotating shaft 70 and therefore moves along with the rotating shaft 70.

The slider 75 is provided further above the fulcrum supporter 73. The slider 75 has a cylindrical shape and is provided around the periphery of the rotating shaft 70. Splines, fitting grooves, etc. (not shown) are formed on an inner periphery of the slider 75 and the splines engages the rotating shaft 70. Thus, the slider 70 is allowed to rotate together with the rotating shaft 70, but is movable in an axial direction of the rotating shaft. A ring 79 is provided around an outer periphery of the slider 75. The ring 79 is rotatable relative to the slider 75, while being integrally coupled to the rotating shaft in the axial direction.

All the three chuck claws 35 have a block shape. Each of the chuck claws has a claw portion 76 protruding inwardly at its lower end. Further, apertures 77 are provided in two places in a block-shaped portion of the chuck claw 35. The apertures 77 are provided vertically parallel. The three chuck claws 35 are disposed around the guide supporter 72. The guide pins 36 protruding from the guide supporter 72 are inserted into the apertures 77 in two places. Accordingly, the three chuck claws 35 are allowed to move parallel along the guide pins 36. Further, stoppers (not shown) are provided at the guide pins 36 and therefore the chuck claws 35 are not permitted to separate from the guide pins 36.

Each of the three sets of link mechanisms 59 include two link pieces 78*a*, 78*b*. One link piece 78*a* is long, while the other link piece 78*b* is short. The one link piece 78*a* is tiltably attached to the fulcrum supporter 73 through a pin 80 at its middle portion. Further, an elongated aperture 74 is provided at a leading end of the link piece 78*a*. The link piece 78*a* is connected to the chuck claw 35 as a pin 89 is inserted into the elongated aperture 74. Accordingly, the leading end of the link piece 78*a* is pivotable relative to the chuck claw 35 and is connected thereto with degrees of freedom in the axial direction.

On the other hand, the link piece 78*a* is linked to the other link piece 78*b* via a pin 81 at its proximal end. The other link piece 78*b* is attached to the slider 75 via a pin 82.

Figure 9:
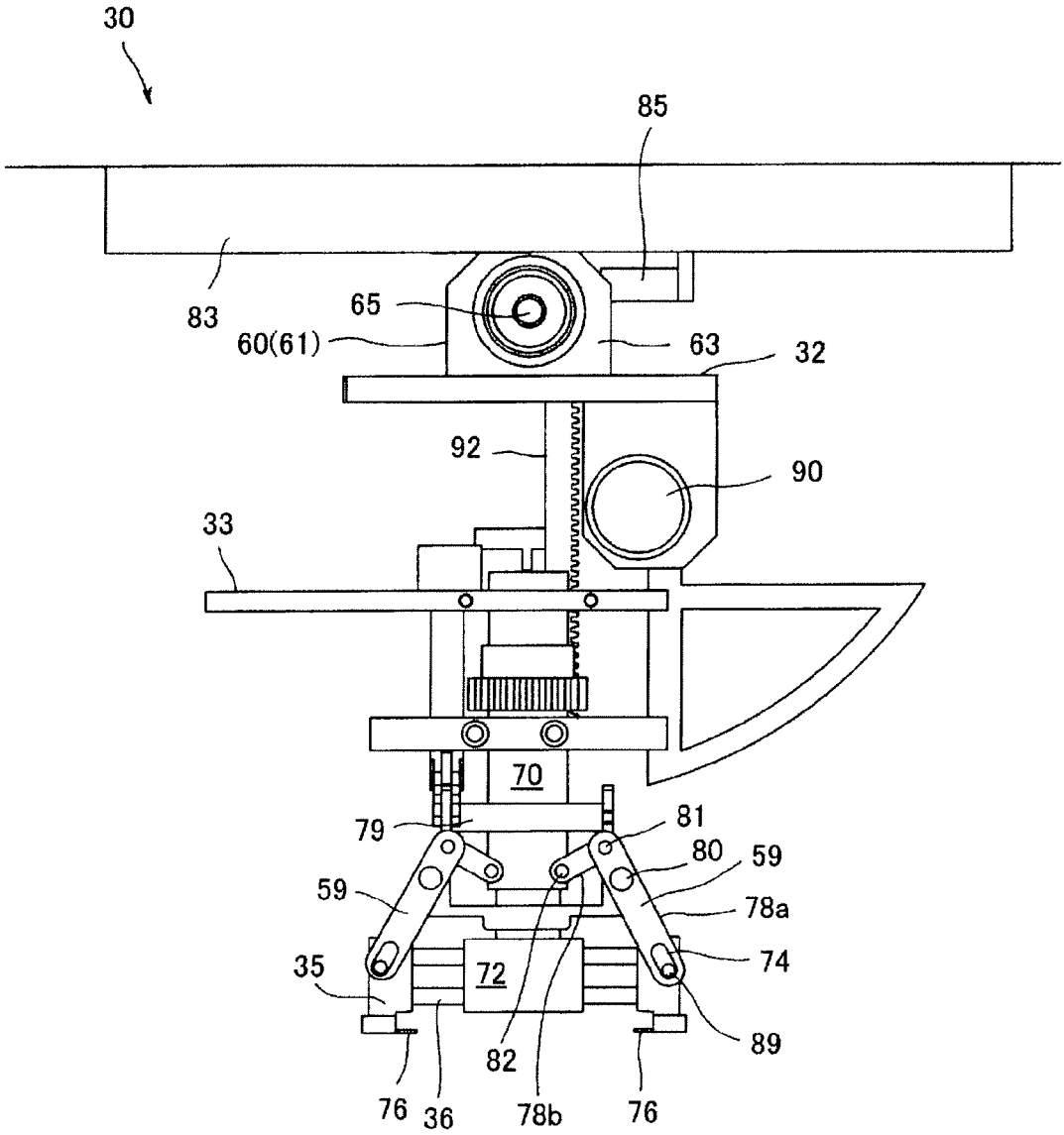
FIG. 9 is a front view of the lid rotating device shown in FIG. 8, illustrating that a slider is lifted and chuck claws are opened.
Figure 10:
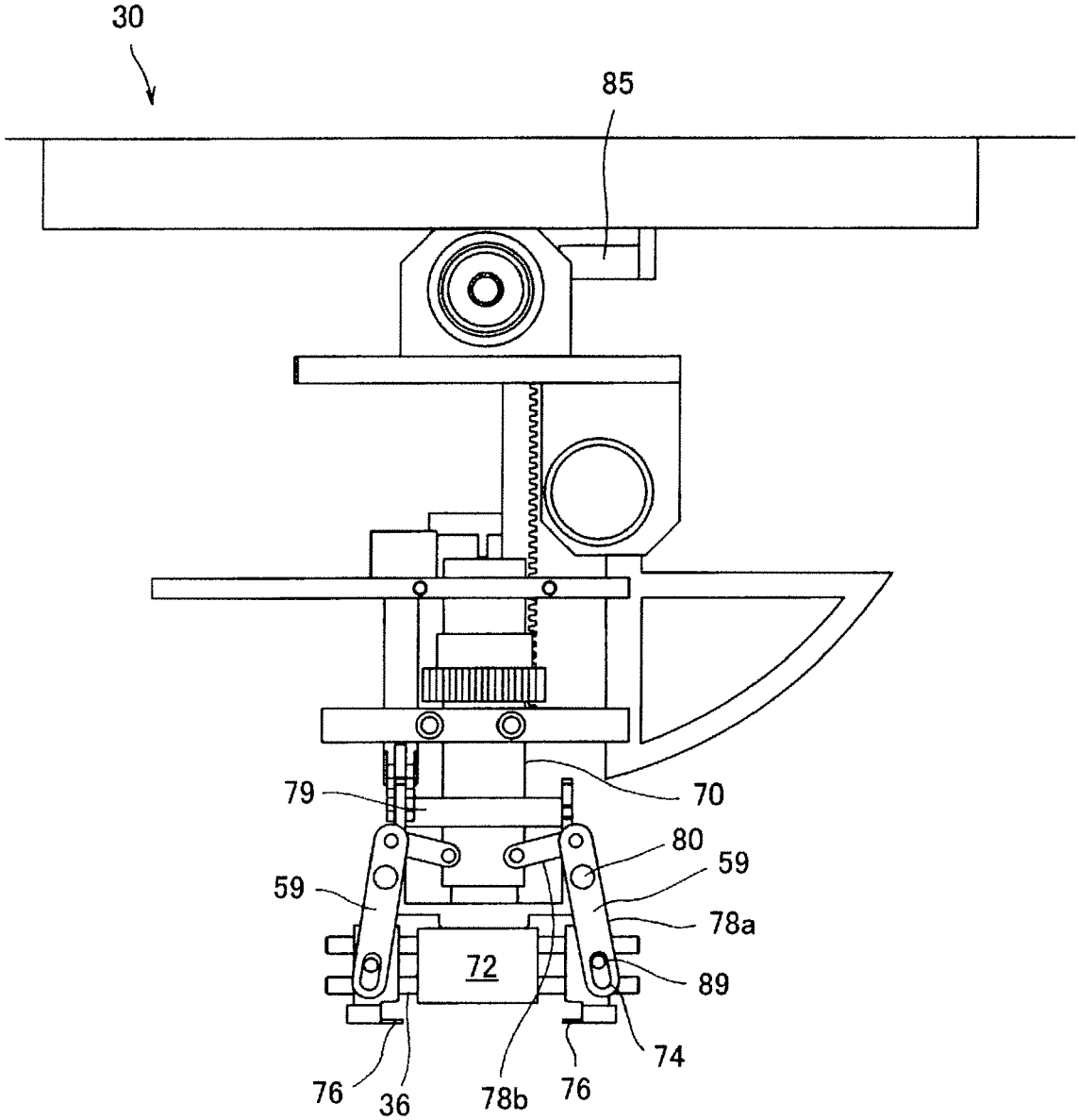
FIG. 10 is a front view of the lid rotating device shown in FIG. 8, illustrating that the slider is lowered down and the chuck claws are closed.

Accordingly, as the slider 75 is lifted or lowered, the link mechanisms 59 operate as shown in FIGS. 9 and 10, thereby opening or closing the three chuck claws 35. FIG. 9 is a front view of the lid rotating device shown in FIG. 8, illustrating that the slider is lifted to open the chuck claws. FIG. 10 is a front view of the lid rotating device shown in FIG. 8, illustrating that the slider is lowered to close the chuck claws. The principle of opening and closing the chuck claw is as follows. As described above, since the link piece 78*a* in a longer side is joined to the fulcrum supporter 73 via the pin 80 at its middle portion, the link piece 78*a* is allowed to have a degree of freedom only in a tilting direction relative to the central pin 80.

Further, the guide pins 36 are inserted to the chuck claw 35. Thus, the chuck claw 35 is allowed to have a degree of freedom only in a linear direction along the guide pins 36. Also, the link piece 78*a* in a longer side is joined to the chuck claw 35 at its leading end. Thus, if the link piece 78*a* is tilted to be positioned nearly vertically, then the link piece 78*a* pivots about the pin 80 and the leading end side (e.g., the elongated aperture 74 side) of the link piece 78*a* moves toward the rotating shaft 70 (i.e., toward a center), thereby moving the chuck claw 35 toward a center.

On the other hand, when the link pieces 78*a* are tilted and take a shape of a reverse V, the leading end side of the link piece 78*b* moves away from the pin 80 existing in the middle portion of the link piece 78*a* to move the chuck claw 35 in an opening direction. Further, the link piece 78*a* in a longer side is connected to the slider 75 at its proximal end via the link piece 78*b* in a shorter side. Thus, when the slider 75 is lifted up, the link piece 78*a* is tilted into a nearly vertical position and the chuck claw 35 is closed. On the contrary, when the slider 75 is lowered, the link piece 78*a* is put into an inclined position and the chuck claw 35 is opened.

Next, the tilting table 32 and the lifting and lowering table 33 will be described. As shown in FIG. 9, the tilting table 32 is vertically hung to an exterior frame 83 of the vial lid fastening device 30 via a tilting shaft 65. Specifically, the tilting table 32 has a shape of a rectangular plate. Tilting shaft supporting members 60, 61 are provided at middle sections of edges that are opposed forward and backward (forward and backward with reference to FIG. 8). The tilting shaft supporting member 60, 61 has a wall surface 63 vertically provided at the tilting table 32. The tilting shaft 65 protrudes outwardly from the wall surface 63. Accordingly, the tilting shaft 65 protrudes forward and backward with reference to FIG. 8. The tilting shaft 65 is integrally fixed to the tilting shaft supporting members 60, 61 and is not allowed to relatively rotate relative to the tilting shaft supporting members 60, 61. Inside the two tilting shaft supporting members 60, 61, a gear 66 is provided at the tilting shaft supporting member 60 that is at a front side with reference to FIG. 8. The gear 66 is also integrally provided at the tilting shaft supporting member 60 and is not relatively rotated.

The gear 66 engages a worm gear 84 attached to the exterior frame 83. Specifically, a tilting motor 85 is provided at the exterior frame 83 of the lid rotating device 51 and the worm gear 84 coupled to the tilting motor 85 engages the gear 66 fixed to the tilting shaft 65. Thus, when the tilting motor 85 operates, the gear 66 is rotated by means of the worm gear 84 and the tilting shaft 65 integrally combined with the gear 66 pivots, thereby tilting the tilting table 32 about the tilting shaft 65.

A rotating motor 86 is placed on an upper side of the tilting table 32. A rotating shaft of the rotating motor 86 extends downwardly by means of an extension shaft 87. A gear 88 is coupled to a leading end of the extension shaft. The gear 88 is meshed with the above-described gear 71 of the rotating device body 34. Further, a lifting and lowering motor 90 is attached to a lower side of the tilting table 32. A gear 91 is coupled to a leading end of the lifting and lowering motor 90. The gear 91 is meshed with a lifting and lowering rack 92 that will be described below.

Further, a rotation position detecting indication member 93 is provided at a back side of the tilting table 32. The rotation position detecting indication member 93 has a sector shape of about 90 degrees and is fixed to the tilting table 32 through an attachment member 95. A circular arc, which an outer periphery of the rotation position detecting indication member 93 forms, is concentric with the tilting shaft 65 of the tilting table 32. Further, a circular-arc shaped outer peripheral surface of the rotation position detecting indication member 93 has scales (not shown) thereon. Further, sensors 94, 97, 98 are provided around the outer periphery of the rotation position detecting indication member 93. The rotation position detecting indication member 93 is tilted together with the tilting table 32. At this time, the sensors 94, 97, 98 read changes of the scales to detect a position of the tilting table 32 (e.g., an inclination angle with respect to the horizontal or the vertical). The sensor 98 is for a normal position. The sensor 98 detects whether the tilting table 32 is positioned in a normal position (i.e., a horizontal position). That is, the sensor 98 is used for checking that the rotating device body 34 is in a vertical position. The sensor 94 is used for positioning when the tilting table 32 is tilted toward a left side. That is, the sensor 94 detects that when the tilting table 32 is tilted toward a left side, the rotating device body 34 is directed toward the lid placing member 53. Further, the sensor 97 is used for positioning when the tilting table 32 is tilted toward a right side. That is, the sensor 94 detects that when the tilting table 32 is tilted toward a right side, the rotating device body 34 is directed toward the lid placing member 52.

The lifting and lowering table 33 is disposed below the titling table 32 and is coupled to the tilting table 32 by means of a slide mechanism (not shown). Thus, the lifting and lowering table 33 is integrally moved in a tilting direction relative to the tilting table 32, but is attached with a degree of freedom in lifting and lowering directions.

The lifting and lowering rack 92 is fixed to the lifting and lowering table 33. The lifting and lowering rack 92 is vertically disposed relative to the lifting and lowering table 33. Further, the lifting and lowering rack engages the above-described gear 91 of the lifting and lowering motor 90. Thus, when the lifting and lowering motor 90 operates to rotate the gear 91, the lifting and lowering rack 92 engaging the gear 91 is moved in the axial direction and thereby a relative distance between the lifting and lowering table 33 and the tilting table 32 changes.

As described above, the rotating device body 34 is vertically hung to the lifting and lowering table 33. Specifically, the rotating device body 34 is vertically hung to the lifting and lowering table 33 as the rotating shaft 70 is attached to the lifting and lowering table 33. The rotating shaft 70 of the lifting and lowering table 34 is rotatable relative to the lifting and lowering table 33, but is integrally coupled thereto in a vertical direction.

Further, an opening and closing motor 38 and an opening and closing rack 39 are attached to the lifting and lowering table 33. The opening and closing motor 38 is attached to the lower surface of the lifting and lowering table 33. A gear 96 is coupled to a leading end of the opening and closing motor 38. Furthermore, the opening and closing motor 38 is attached to the lifting and lowering table 33 via a guide (not shown) and has a vertical degree of freedom relative to the lifting and lowering table 33. Thus, when the opening and closing motor 38 operates, the opening and closing rack 39 is moved in the axial direction by means of the gear 96. Further, a leading end of the opening and closing rack 39 is coupled to the ring 79 of the slider 75 via a connection member 99. Thus, when the opening and closing motor 38 operates, the opening and closing rack 39 is moved in the axial direction as described above, and the slider 75 is also moved in the axial direction via the connection member 99. As a result, as shown in FIGS. 9 and 10, the link mechanisms 59 actuate to open or close the three chuck claws 35.

The functions of the lid rotating device 51 may be summarized as follows. That is, when the tilting motor 85 provided at the exterior frame 83 of the lid rotating device 51 operates, the tilting shaft 65 is rotated together with the gear 66 and the tilting table 32 integrally combined therewith is tilted. Then, the lifting and lowering table 33 and the rotating device body 34 vertically hung to the lifting and lowering table 33 are tilted to change their position.

When the lifting and lowering motor 90 provided at the lower surface of the tilting table 32 operates, the gear 91 is rotated and the lifting and lowering rack 92 is vertically moved and the lifting and lowering table 33 is moved upwardly and downwardly. Thus, the rotating device body 34 is vertically hung so that the lifting and lowering table 33 is lifted or lowered.

When the opening and closing motor 38 attached to the lower surface of the lifting and lowering table 33 operates, the opening and closing rack 39 is moved upwardly and downwardly by means of the gear 96. Further, the leading end of the opening and closing rack 39 is coupled to the ring 79 of the slider 75 via the connection member 99. Accordingly, when the opening and closing motor 38 operates, the opening and closing rack 39 is moved upwardly and downwardly as described above and the slider 75 is moved in the axial direction by means of the connection member 99. Therefore, as shown in FIGS. 9 and 10, the link mechanisms 59 actuate to open and close the three chuck claws 35.

When the rotating motor 86 provided at the upper surface of the tilting table 32 operates, the gear 71 of the rotating device body 34 that engages the gear 88 is rotated and the rotating shaft 70 of the rotating device body 34 is rotated. Therefore, the three chuck claws 35 are rotated together with the guide supporter 72 which is integrally combined with the rotating shaft 70. The link pieces 78*a*, 78*b* for opening and closing the chuck claws 35 are rotated together with the chuck claws 35 and the slider 75 with the link piece 78*b* joined thereto is also rotated. However, the ring 79 attached to the slider 75 is permitted to rotate relative to the slider 75. Therefore, the ring 79, the connection member 99 attached to the ring 79 and the opening and closing rack 39 do not rotate.

Next, the lid placing member will be described. Two sets of the lid placing members 52, 53 are employed in this embodiment in order to cope with sizes of the vial 1. That is, the vials 1 are configured to have a plurality of sizes and the lid bodies 3 have different sizes accordingly. Thus, in this embodiment, two sets of lid placing members 52, 53 are employed in order to cope with two kinds of vials. Both of them have the same parts except for the dimensions. Thus, the parts of the lid placing member will be described by way of example of the lid placing member 52 on the left side. As shown in FIG. 7, the lid placing member 52 has an inclined slide 100. A terminal mechanism part 101 is provided near a lower end of the inclined slide 100.

Figure 11:
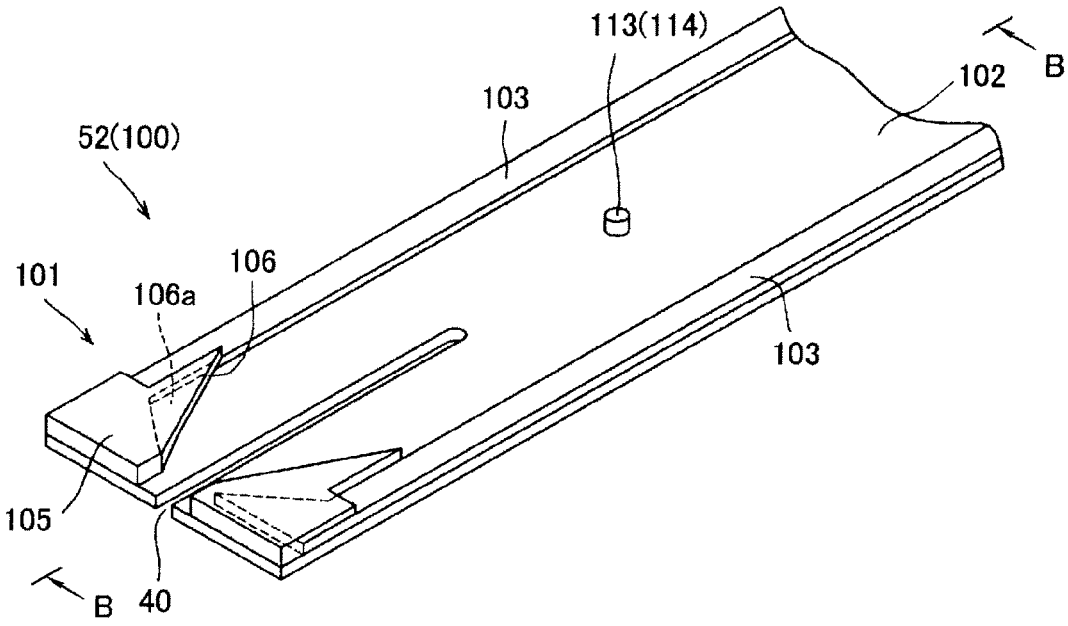
FIG. 11 is a perspective view of a lid placing member provided at a transporting device.
Figure 12:
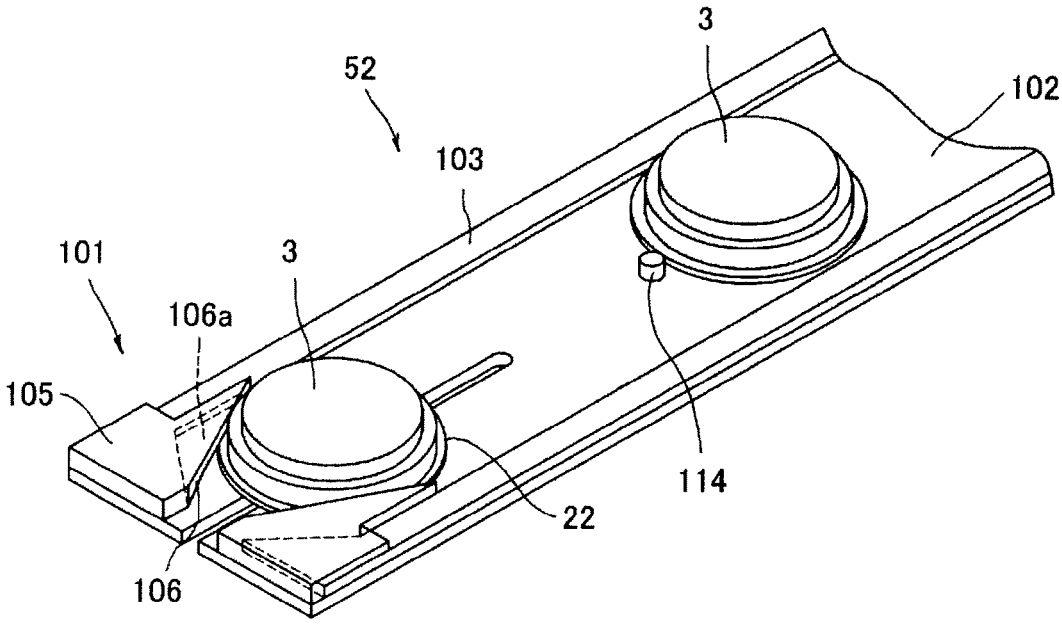
FIG. 12 is a perspective view of the lid placing member with the lid placed thereon.
Figure 13:
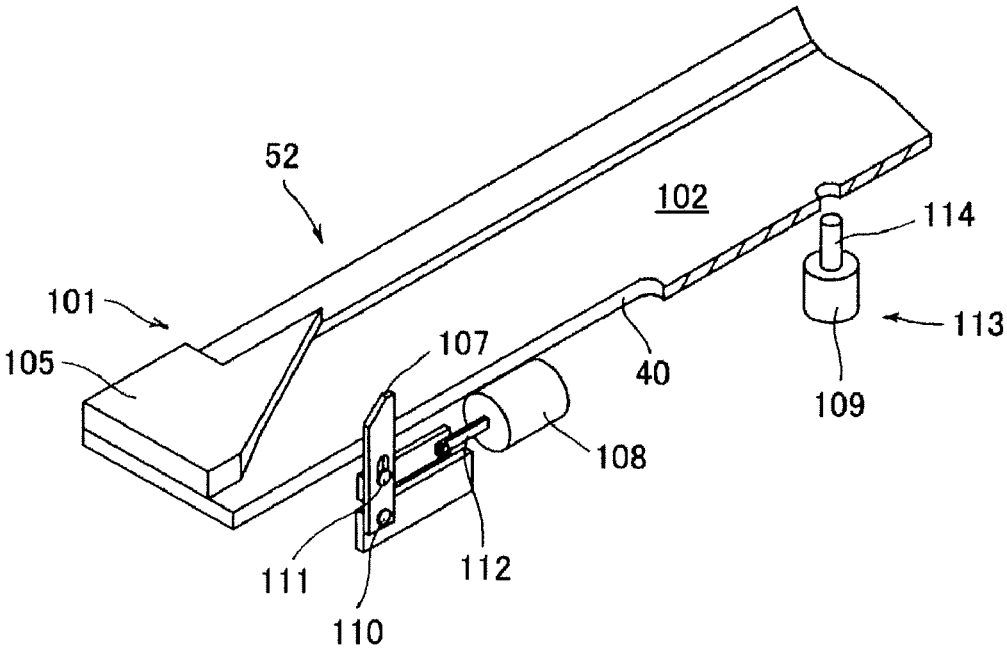
FIG. 13 is a perspective view showing a section taken along the line B-B of FIG. 11.

FIG. 11 is a perspective view of the lid placing member provided in the transporting device. FIG. 12 is a perspective view of the lid placing member with the lid placed thereon. Further, FIG. 13 is a sectioned perspective view taken along the line B-B of FIG. 11.

The inclined slide 100 of the lid placing member 52 is a member for sliding down the lid body 3 of the vial 1. The inclined slide has an inclined flat surface (inclined placing surface) 102. As shown in FIG. 11, guide walls 103 are provided at lateral sides of the inclined flat surface 102. The guide walls 103 vertically extend from the lateral sides of the inclined flat surface 102. Spacing between a lower end of the inclined flat surface 102 of the lid placing member 52 and a lower end of an inclined flat surface 102 of the lid placing member 53 (see FIG. 7) is slightly larger than the outer diameter of the opening of the lid body 3. Further, a height of the guide wall 103 is slightly higher than that of the extended-diameter section 22 of the lid body 3.

The terminal mechanism part 101 of the lid placing member 52 includes a stepped section holder 105. The stepped section holder 105 is configured to cover a portion of an upper surface of the inclined flat surface 102 at the terminal end of the lid placing member 52. Specifically, the stepped section holder 105 is configured to provide an abutment member 106 of a generally triangular shape inside the guide walls 103 at the terminal end of the lid placing member 52. Thus, a space 106*a*, which the extended-diameter section 22 can enter, is defined in the terminal mechanism part 101 by the guide wall 103, the abutment member 106 and the inclined flat surface 102.

Further, in the terminal mechanism part 101 of the lid placing member 52, a slit 40 is provided in the middle of the inclined flat surface 102. A rotation preventing member 107 protrudes from or is retracted to a lower side of the slit 40. Specifically, the rotation preventing member 107 and a solenoid 108 for actuating the same are provided below the slit 40. The rotation preventing member 107 has a bar shape. The rotation preventing member is attached to a portion of the lid placing member 52 at its lower end via a pin 110. Thus, the rotation preventing member 107 is tiltable about the pin 110 at its lower end. Further, a rod 112 of the solenoid 108 is connected to a middle portion of the rotation preventing member via a pin 111. Accordingly, if the rod 112 of the solenoid 108 protrudes, then the rotation preventing member 107 changes into an inclined position and sinks below the slit 40. On the contrary, if the rod 112 is retracted, then the rotation preventing member 107 changes into an erect position and therefore a leading end of the rotation preventing member 107 protrudes above the slit 40, as shown in FIG. 13.

Further, a stopper mechanism part 113 is provided at an upstream region of the lid placing member 52. The stopper mechanism part 113 includes a solenoid 109 and a pin 114. The stopper mechanism part is configured such that the pin 114 protrudes upwardly from the inclined flat surface 102 to prevent a subsequent lid body 3 from sliding down until a front lid body 3 is moved away from the lid placing member 52. Operations of the vial lid fastening device 30 and movements of the lid body 3 placed on the inclined flat surface 102 (the inclined slide 100) will be described below.

Next, a delivery path for the lid body 3 will be described. The lid body 3 is fed into the first lid body reservoir 115, 116 and is transported by the transporting device 55 to reach the lid placing member 52. This embodiment includes two sets of the first lid body reservoirs 115, 116 and the transporting devices 55, 56. The two sets have the same constitution. Accordingly, the constitution of the first lid body reservoir 115, 116 and the transporting device 55 will be described by way of example of the left delivery path, while descriptions on the right delivery path (the transporting device 56) will be omitted.

The vial lid fastening device 30 has two sets of the delivery paths. Accordingly, for example, the right delivery path can be used for larger-diameter lid bodies 3(3*a*), while the left delivery path can be used for smaller-diameter lid bodies 3(3*b*). Both of the delivery paths are basically identically configured. Different parts will be described later.

In this embodiment, the delivery path for the lid body 3 comprises the first lid body reservoir 115, a fist conveyor 133, a second lid body reservoir 117 and a second conveyor 118. The first lid body reservoir 115 is a space with inner walls 122 extending quadradirectionally and communicates with a lid body feeding inlet 41 and a feeding passage 121. The feeding passage 121 also has inner walls extending quadradirectionally. However, an opening 125 is provided in a middle portion of an inner wall 123 facing the second conveyor 118.

Further, a lid body overfilling sensor 44 is disposed lower than the opening 125 of the inner wall 122(123). The lid body overfilling sensor 44 is a sensor for detecting whether the lid bodies 3 are excessively accommodated in the first lid body reservoir 115. Specifically, when the lid bodies 3 are accommodated beyond the opening 125, the lid body 3 that is not in a normal position cannot be retrieved from the second conveyor 119 and such a lid body 3 may be conveyed to the lid placing member 52. However, due to the lid body overfilling sensor 44, the foregoing problems can be avoided. Further, a lid body remainder sensor 45 is disposed near the lower end of the inner wall 122(123). The lid body remainder sensor 45 is a sensor for detecting whether the lid bodies 3 accommodated in the first lid body reservoir 115 decrease below a predetermined quantity. Since the lid body overfilling sensor 44 and the lid body remainder sensor 45 are provided, excess and deficiency in quantity of the lid bodies 3 in the first lid body reservoir 115 can be detected. That is, a second lid body sensor is comprised of the lid body overfilling sensor 44 and the lid body remainder sensor 45.

While not shown, a door that is closed at a normal time may be provided at a bottom of the first lid body reservoir 115. Preferably, the door may be provided to prepare for when there is an excess of lid bodies 3 in the first lid body reservoir 115, when foreign substances are introduced, or when the lid body 3 needs to be removed for some reasons. Further, it is preferable that the door has a warning function of warning its open state in order to prevent troubles before they occur in the device especially when the opened door is neglected.

Figure 14:
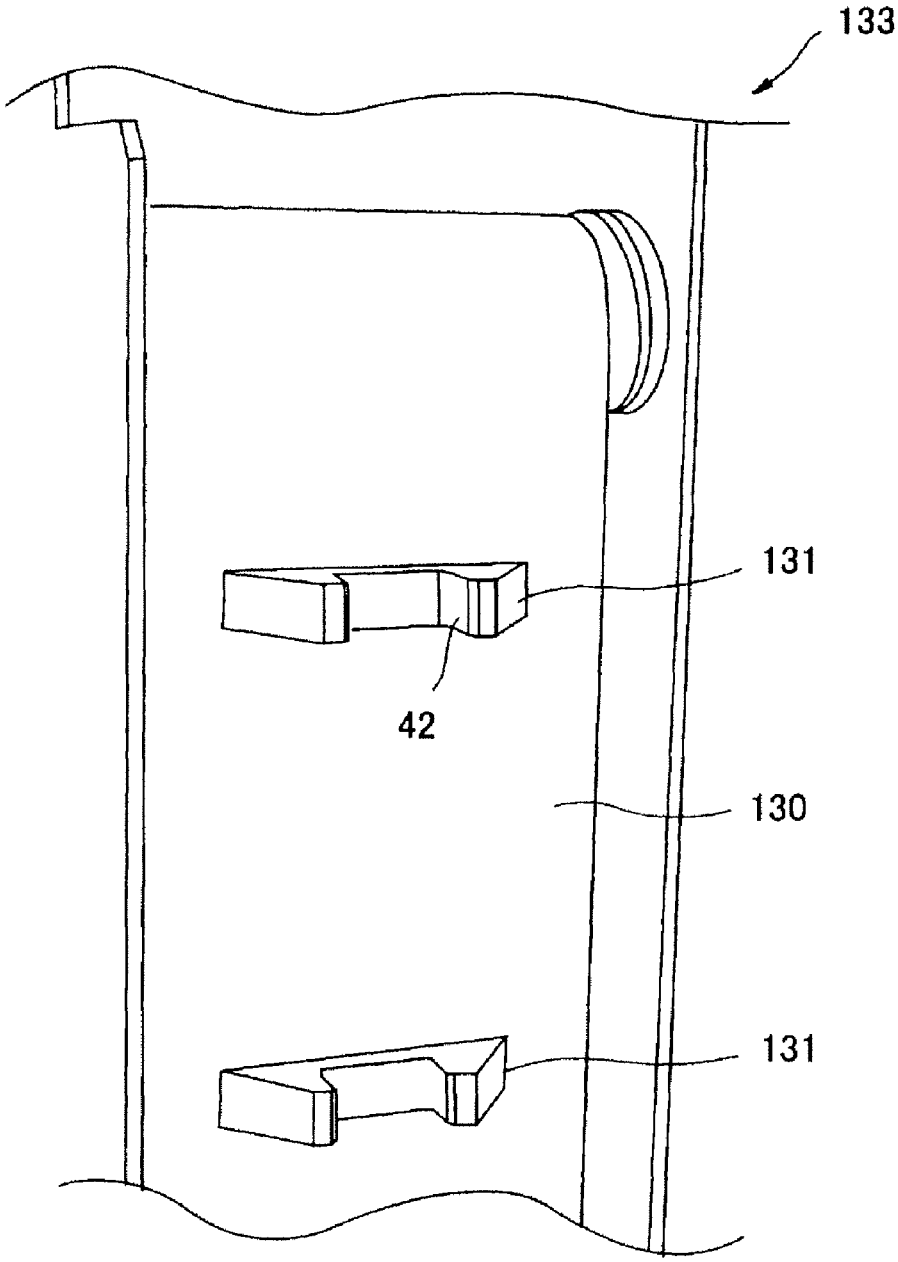
FIG. 14 is a perspective view showing a belt and placing mounts of a first conveyor.

The first conveyor 133 moves the lid body 3 in the first lid body reservoir 155 to the second lid body reservoir 117. The first conveyor 133 includes a plurality of pulleys and a conveyor belt 130 wound around the pulleys. In the conveyor belt 130 employed in this embodiment, placing mounts 131 are attached to the conveyor belt at regular intervals. FIG. 14 is a perspective view showing the belt and the placing mounts of the first conveyor.

The placing mount 131 is molded from a metallic or plastic material. The placing mount comprises a block having a concave shape. Specifically, the placing mount 131 comprises a block having a cutaway portion 42, which is formed by cutting away a rectangular middle portion of such a block, in its middle section. The placing mount 131 is attached to the conveyor belt in such a manner that an open side of its cutaway portion 43 faces outward and its back side joins the conveyor belt 130. Further, the placing mounts 131 are situated in such a manner that the placing mount 131 extends in lengthwise direction perpendicularly to a lengthwise direction of the conveyor belt 130, and the cutaway portions 43 of the respective placing mounts 131 are juxtaposed along the lengthwise direction of the conveyor belt 130.

As shown in FIG. 7, a conveyance path of the first conveyor 133 includes a horizontal section 126 and an erected section 127. A portion of the horizontal section of the first conveyor 133 is situated within the first lid body reservoir 115. The first conveyor 133 comes to the sharp erected section after going out of the first lid body reservoir 115. And, it rapidly comes to a descent path 134 from an apex portion 132 of the erected section. The descent path 134 is oriented at an angle of more than 90 degrees, thereby forming a conveyance path with the apex portion 132 pushed aside.

The second lid body reservoir 117 is situated right below the apex portion 132 of the first conveyor 133. The second lid body reservoir 117 is also a space with inner walls extending quadradirectionally.

Figure 15:
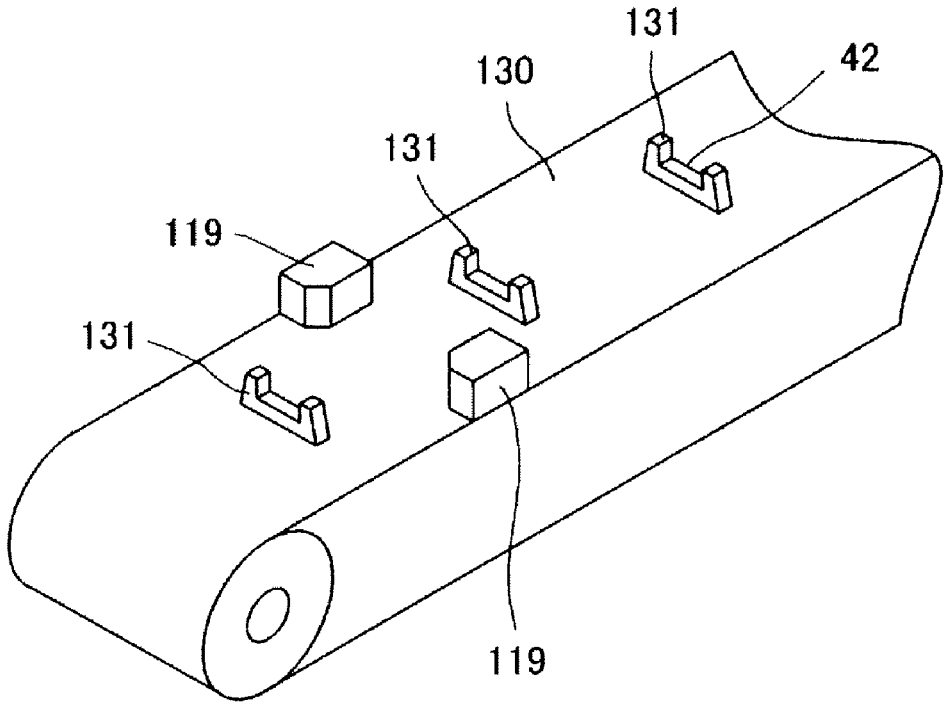
FIG. 15 is a perspective view showing a horizontal section of a second conveyor.
Figure 16:
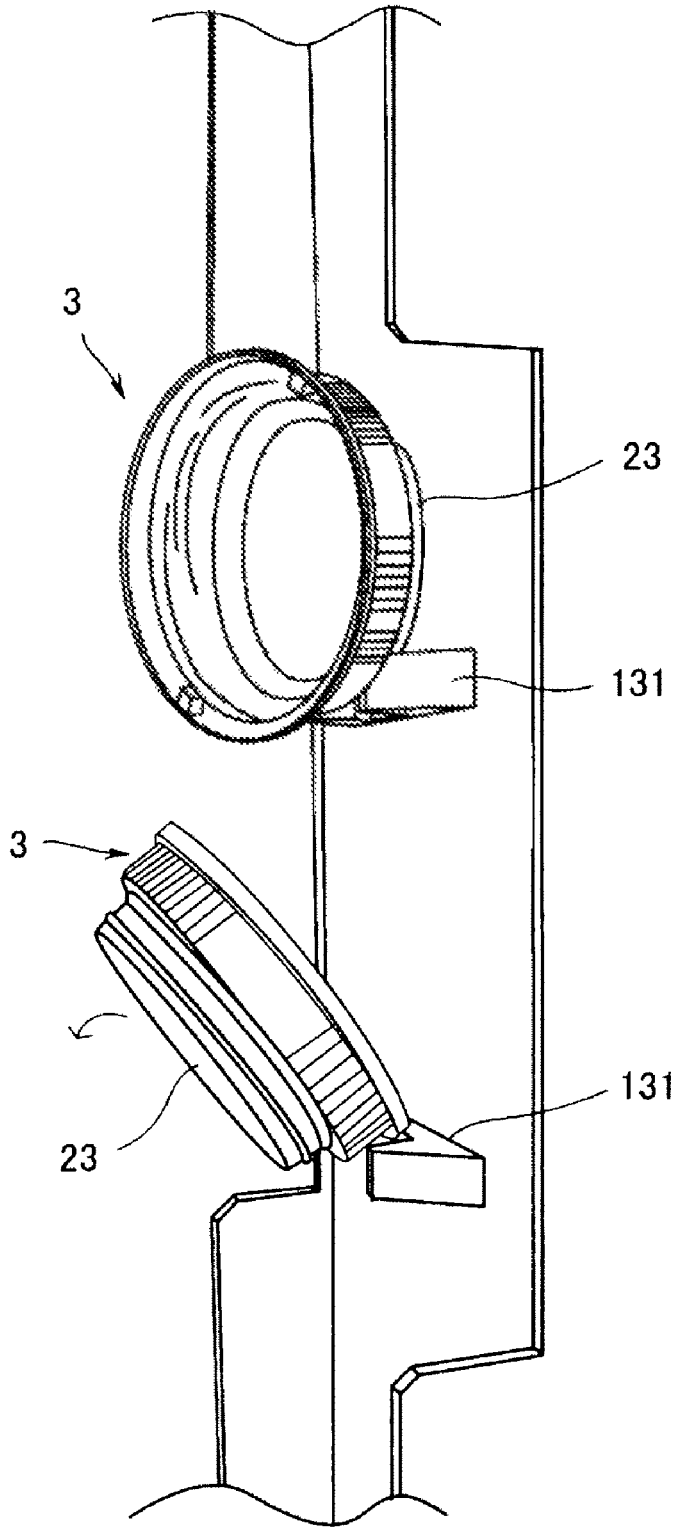
FIG. 16 illustrates behavior of the lid body in an erected section of the second conveyor.

Next, the second conveyor 118 will be described. FIG. 15 is a perspective view showing a horizontal section of the second conveyor. FIG. 16 illustrates behavior of the lid body in an erected section of the second conveyor. Similarly to the first conveyor 133, the second conveyor 118 includes a plurality of pulleys and a conveyor belt 130 wound around the pulleys. Further, the conveyor belt employed in the second conveyor 118 is the same as that of the first conveyor 133 and placing mounts 131 are attached to the conveyor belt 130.

As shown in FIG. 7, a conveyance path of the second conveyor 118 comprises a horizontal section 135 and an erected section 136. Specifically, a portion of the horizontal section 135 of the second conveyor 118 is situated within the second lid body reservoir 117. Guide blocks 119 are provided bilaterally at the horizontal section 135 of the second conveyor 118. The guide blocks 119 serve to move the lid body 3 on the conveyor belt 130 toward its center.

Further, catch prevention sensors 46, 47 are provided at the horizontal section 135. The catch prevention sensors 46, 47 are disposed in a direction orthogonal to a conveyance direction of the conveyor belt 130. The catch prevention sensors 46, 47 detect the lid body 3 on the horizontal section 135. A control device (not shown) controls the first conveyor 133 based on detection signals inputted from the catch prevention sensors 46, 47 so that the lid bodies 3 do not overlap each other on the horizontal section 135. Specifically, the control device controls the first conveyor 133 in such a manner that next lid body 3 is not dropped while any one of the catch prevention sensors 46, 47 detects a lid body 3, and that next lid body 3 is dropped when both of the catch prevention sensors 46, 47 detect no lid body 3.

The second conveyor 118 comes to a sharp erected section 136 after going out of the second lid body reservoir 117. An angle of the erected section 136 of the second conveyor 118 is in a range of 80 degrees to 100 degrees and thus the erected section is oriented almost vertically. More preferably, its inclination angle is in a range of 87 degrees to 89 degrees. That is, it is inclined to a near vertical position, but its inclination is not to the extent of overhang. The erected section 136 of the second conveyor 118 is disposed in a space between the feeding passage 121 and a wall constituting an exterior of the vial lid fastening device 30. Accordingly, the wall surface of the feeding passage 121 faces toward a front portion of a conveyance side of the erected section 136 of the second conveyor 118.

A guide wall 140 is provided at an apex portion 137 of the erected section 136 of the second conveyor 118. The guide wall 140 includes a circular-arc-shaped wall surface.

Figure 17:
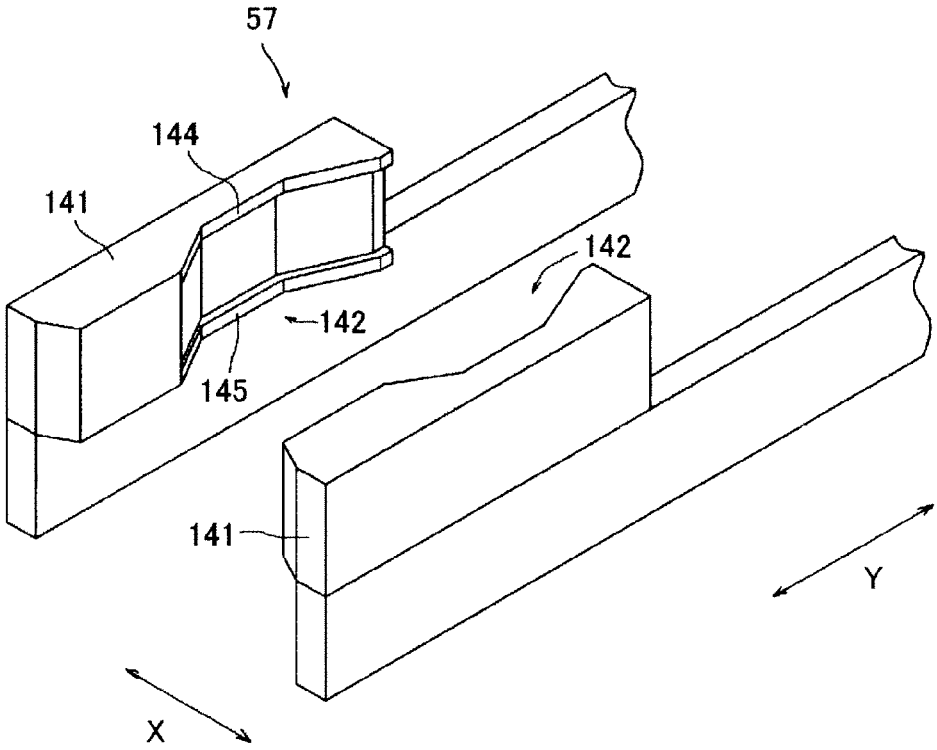
FIG. 17 is a perspective view of a vial body holding and supplying device.

Next, the vial body holding and supplying device 57 will be described. FIG. 17 schematically illustrates the vial body holding and supplying device. The vial body holding and supplying device 57 has two arms 114. The vial body holding and supplying device can open and close the arms 141 by means of an opening and closing mechanism (not shown). That is, the two arms 141 can be moved in a direction of an arrow X and hold the vial body 2 while sandwiching it therebetween. The arms 141 employed in this embodiment are configured to be maintained horizontally and to move toward or away from each other. Concave portions 141 are provided in the arms 114 for sandwiching lateral partial sides of the vial body 2. Further, a portion, which contacts the vial body 2, of the concave portion 142 of the arm 141 is provided with ribs 144, 145. The ribs 144, 145 are situated on an inner surface of the concave portion 142 of the arm 141 while extending horizontally. When the two arms 141 are moved in a closing direction to sandwich the vial body, the ribs 144, 145 serve to strengthen a contact pressure between the arms 141 and the vial body. Thus, such arrangement is preferable. Further, the vial body holding and supplying device 57 is placed on a rail (not shown) and is movable forward and backward in the figure (along a direction of arrow Y) as sandwiching the vial body 2.

Figure 18:
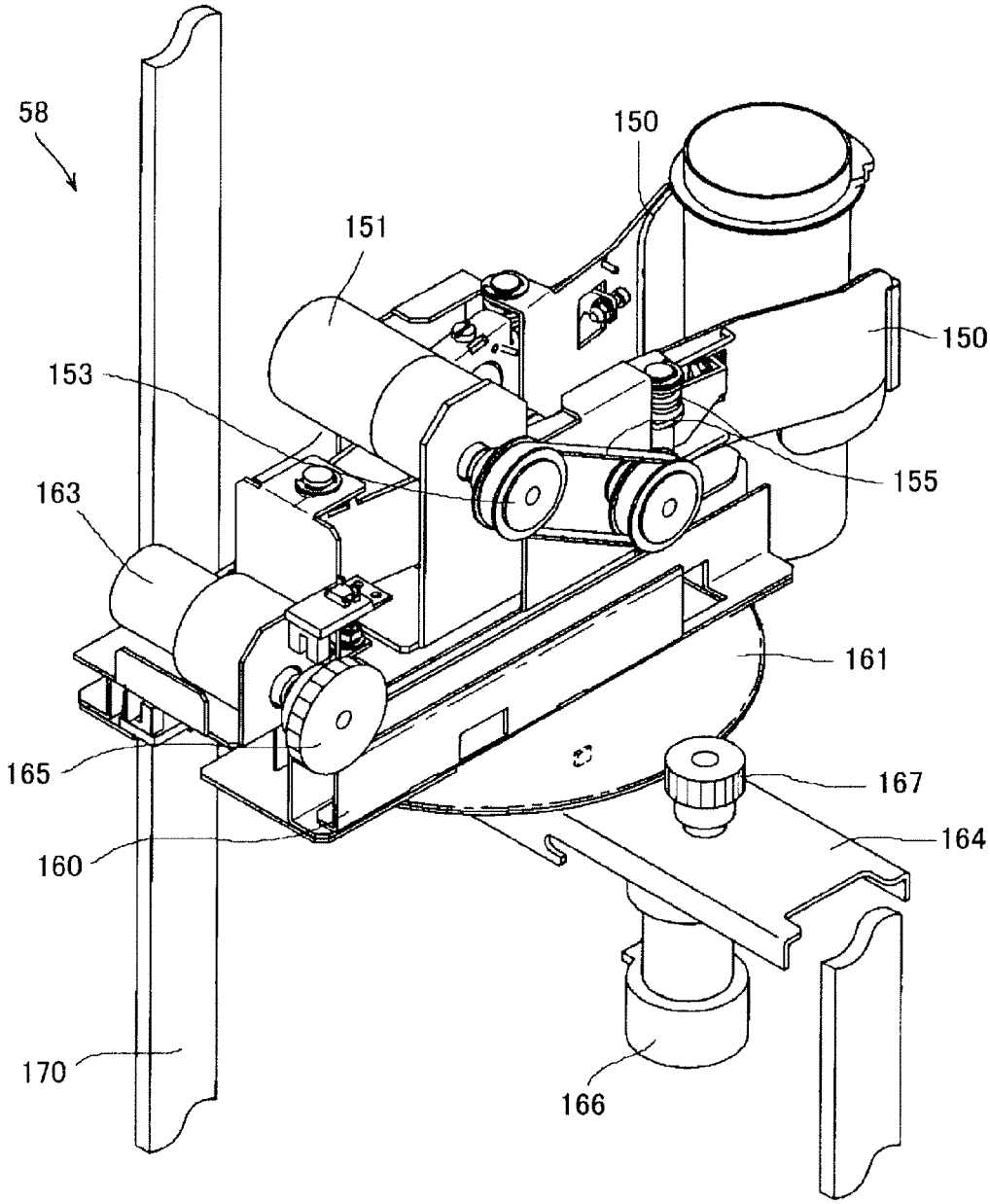
FIG. 18 is a perspective view of a vial discharging device, illustrating that the vial is received from the vial body holding and supplying device.
Figure 19:
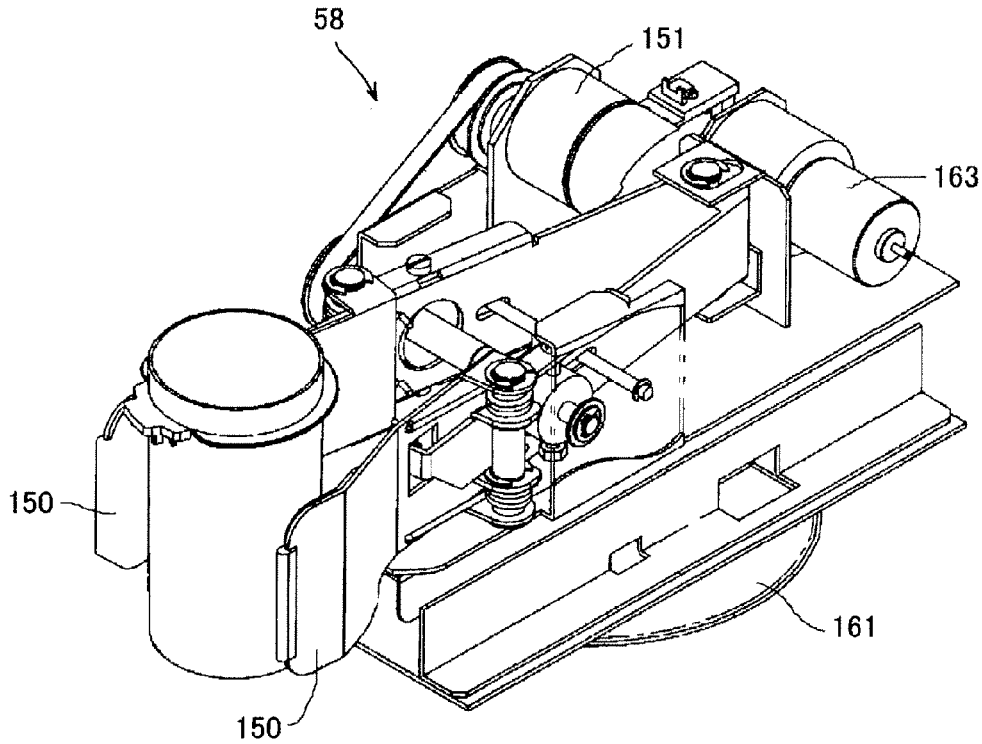
FIG. 19 is a perspective view of the vial discharging device, illustrating that arms are reversed from a position shown in FIG. 18 to dispense the vial.
Figure 20:
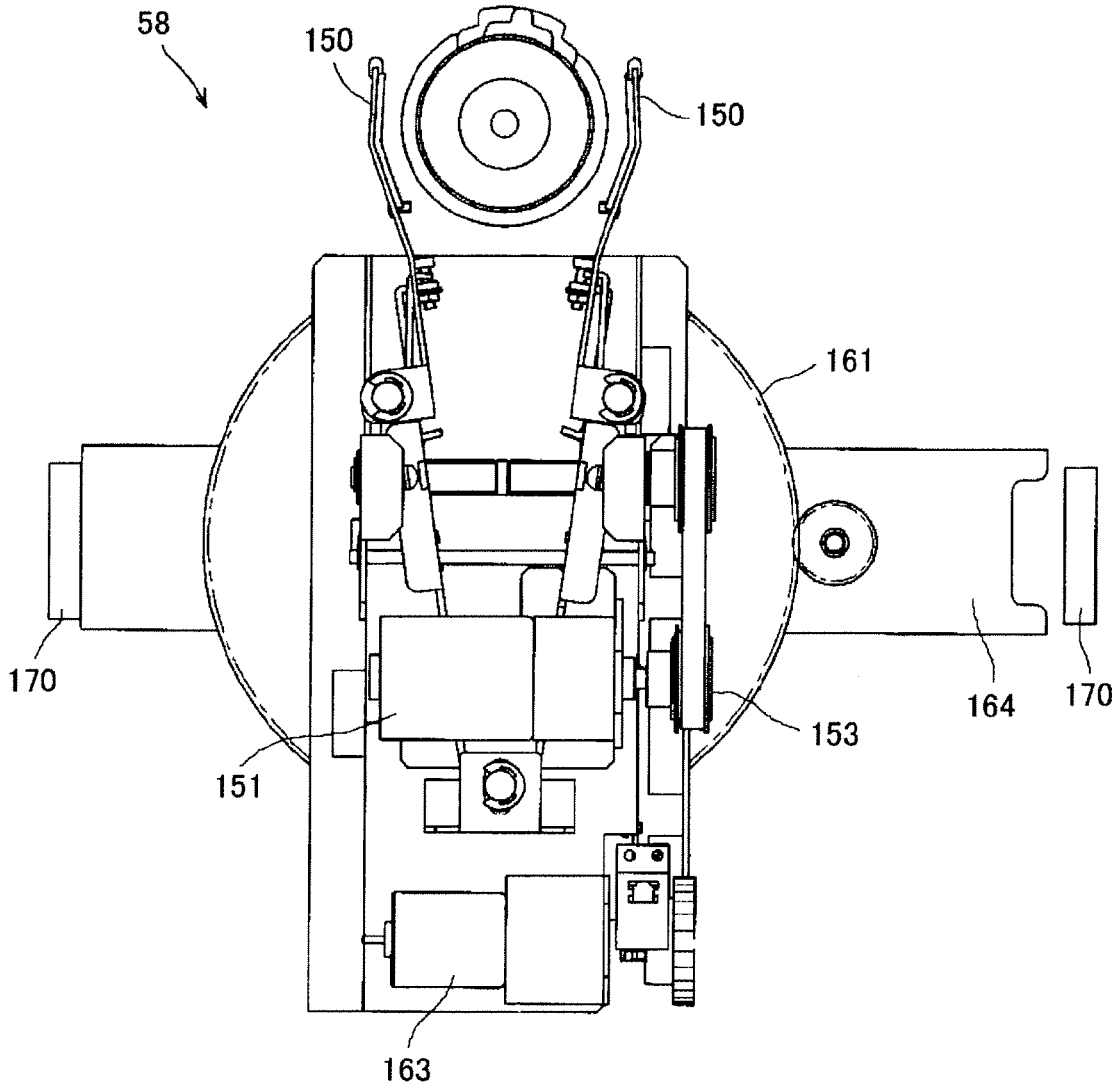
FIG. 20 is a plan view of the vial discharging device shown in FIG. 18.

Next, the vial discharging device 58 will be described. FIG. 18 is a perspective view of the vial discharging device, illustrating that the vial (the vial body) is received from the vial body holding and supplying device. FIG. 19 is a perspective view of the vial discharging device, illustrating that arms are reversed from a position shown in FIG. 18 to dispense the vial. FIG. 20 is a plan view of the vial discharging device shown in FIG. 18.

The vial discharging device 58 is configured to receive the vial 1 from the vial body holding and supplying device 57 and to transfer the same up to a predetermined position. The vial discharging device 58 has a pair of arms 150. A ball screw (not shown) is fitted to the arms 150. The arms 150 are opened and closed by rotating the ball screw. This embodiment includes an arm opening and closing motor 151. A pulley 153 and a belt 155 transmit power, thereby rotating the ball screw to open and close the arms 150. Further, the arms 150 are placed on a slide rail (not shown) and the slide rail is placed on a rotating base 161. The rotating base 161 is placed on a lifting and lowering table 164.

As described above, the arms 150 are placed on the slide rail and are moved linearly along the slide rail. Further, a rack 160 is provided parallel to the slide rail. A traveling motor 163 is attached to a frame supporting the arms 150. A gear 165 that is coupled to a rotating shaft of the traveling motor 163 engages the rack 160. Thus, when the traveling motor 163 operates, the gear 165 is rotated and the arms 150 can be moved linearly along the slide rail.

The rotating base 161 has the shape of a circular disk. The rotating base is rotatably supported on the lifting and lowering table 164. Further, a periphery of the rotating base 161 is formed with teeth such as teeth of a gear. Further, a rotating motor 166 is attached to the lifting and lowering table 164. A gear 167 coupled to the rotating motor 166 engages the gear of the rotating base 161. Thus, when the rotating motor 166 operates, the rotating base 161 is rotated.

The lifting and lowering table 164 is attached to a longitudinal rail 170 that extends vertically. The lifting and lowering table is configured to be vertically lifted and lowered by a toothed belt (not shown).

As described above, the vial lid fastening device 30 comprises: one set of lid rotating device (the lid rotating and fastening means) 51; and two sets of lid placing members 52, 53 and transporting devices 55, 56 transporting the lid body 3(3*a*) to the respective lid placing members 52, 53. The above-described components are arranged as shown in FIG. 7. Specifically, the one set of the lid rotating devices (the lid rotating and fastening means) 51 is vertically hung near a top side of the exterior frame 83 of the vial lid fastening device 30 as centralized in a lateral direction. Further, when the vial lid fastening device 30 is in a vertical position (a base position), a downstream end of each of the lid placing devices 52, 53 is situated near the chuck claws 35. When the vial lid fastening device 30 is in the vertical position (the base position), the vial body holding and supplying device 57 is situated right below the chuck claws 35 and the vial discharging device 58 is situated in a forward position.

Next, operations of the vial lid fastening device 30 will be described according to serial operations from feeding a lid body to discharging a vial. In preparation for operating the vial lid fastening device 30, a large number of lid bodies are fed through the lid body feeding inlet 41 and are stocked in the first lid body reservoir 115. The fed lid body 3 falls through the feeding passage 121 and reaches the first lid body reservoir 115. Although the opening 125 is provided in the middle of the inner wall 123 that constitutes the feeding passage 121, the lid body 3 during its descent is not allowed to go through the opening 125 since the opening 125 opens perpendicularly to a falling direction of the lid body 3. The lid bodies 3 are stacked in the first lid body reservoir 115 in a random state. That is, the lid bodies 3 are stacked in a heap.

When the vial lid fastening device 30 is actuated in such a state, the lid body 3 is removed one by one by the first conveyor 133. That is, if the first conveyor 133 is operated, the heap of the lid bodies 3 collapses and then the lid body 3 rides on the first conveyor 133 (the conveyor belt 130). In the first conveyor 133, a plurality of the lid bodies 3 could be conveyed to be placed on one placing mount 131. The lid body 3 is conveyed by the first conveyor 133. The lid body 3 advances from the horizontal section 126 of the first conveyor 126 to the erected section 127 and ascends along its inclination. At this time, when a plurality of the lid bodies 3 are placed on one placing mount 131, as in most cases, one lid body 3 remains, whereas the others sway and fall off into the middle of the erected section 127.

The lid body 3 reaches the apex portion 132 as only one lid body 3 is placed on the placing mount 131. In the first conveyor 133, since a downstream side, which is lower than the apex portion 132, is inclined at an angle of more than 90 degrees and therefore the apex portion 132 is pushed aside, the lid body 3 falls from the apex portion 132 into the second lid body reservoir 117. In such a case, since the lid bodies 3 fall one by one, the lid bodies 3 are situated in the second lid body reservoir 117 in a manner fairly different from the first lid body reservoir 115. The lid bodies lie scattered.

Accordingly, the second conveyor 118 conveys the lid bodies in a manner that one lid body 3 is placed on one placing mount 131. Further, in the horizontal section 135 of the second conveyor 118, the guide blocks 119 have the lid body 3 centralized.

Subsequently, the lid body 3 reaches the erected section 136 of the second conveyor 118. In the erected section 136, the top and bottom orientation of the lid body 3 can be arranged. That is, as shown in FIG. 16, when the top surface 23 of the lid body 3 faces the conveyor belt, the lid body can be maintained in a state wherein it rides on the placing mount 131. However, when the extended-diameter section 22 faces the conveyor belt, the lid body 3 falls off the placing mount 131 and returns to the first lid body reservoir 115 through the opening 125.

That is, the lid body 3 is formed such that one side (e.g. the extended-diameter section 22) is open and the opposite side (e.g., the top surface 23) is closed. Thus, considering a weight balance of the lid body 3, the top surface 23 is heavy, while the extended-diameter section 22 is light. Therefore, if the lid body 3 is stood erect, the lid body necessarily falls toward the top surface 23. In association with the second conveyor 118, the second conveyor 118 has the erected section 136 and an erection angle of the erected section is extremely sharp. Thus, in the erected section 136 of the second conveyor 118, the lid body 3 takes an erected position and tilts at the top surface 23. In such a state, when the top surface 23 of the lid body 3 faces the conveyor belt, the lid body 3 is supported by the conveyor belt due to the tilting of the top surface and thereby is prevented from falling off the second conveyor 118.

On the contrary, if the lid body is conveyed with the extended-diameter section 22 facing the conveyor belt, the lid body 3 tilts away from the conveyor belt. Therefore, the lid body 3 is allowed to fall off the placing mount 131. As described above, the erected section 136 of the second conveyor 118 is disposed in the space between the feeding passage 121 and the wall constituting the exterior of the vial lid fastening device 30. As a result, the conveyance side of the erected section 136 of the second conveyor 118 faces the wall surface of the feeding passage 121. Thus, if the lid body is conveyed with the extended-diameter section 22 facing the conveyor belt and reaches the erected section 136, the lid body 3 tilts forward to lean against the wall surface of the feeding passage 121 and then ascends along the erected section 136 as it is. In such a case, the opening 125 is provided in the middle of the inner wall 123 of the feeding passage 121 as described above. Accordingly, if the lid body reaches the opening 125, the lid body 3 is no longer supported and then falls into the feeding passage 121 to return to the first lid body reservoir 115.

Figure 21:
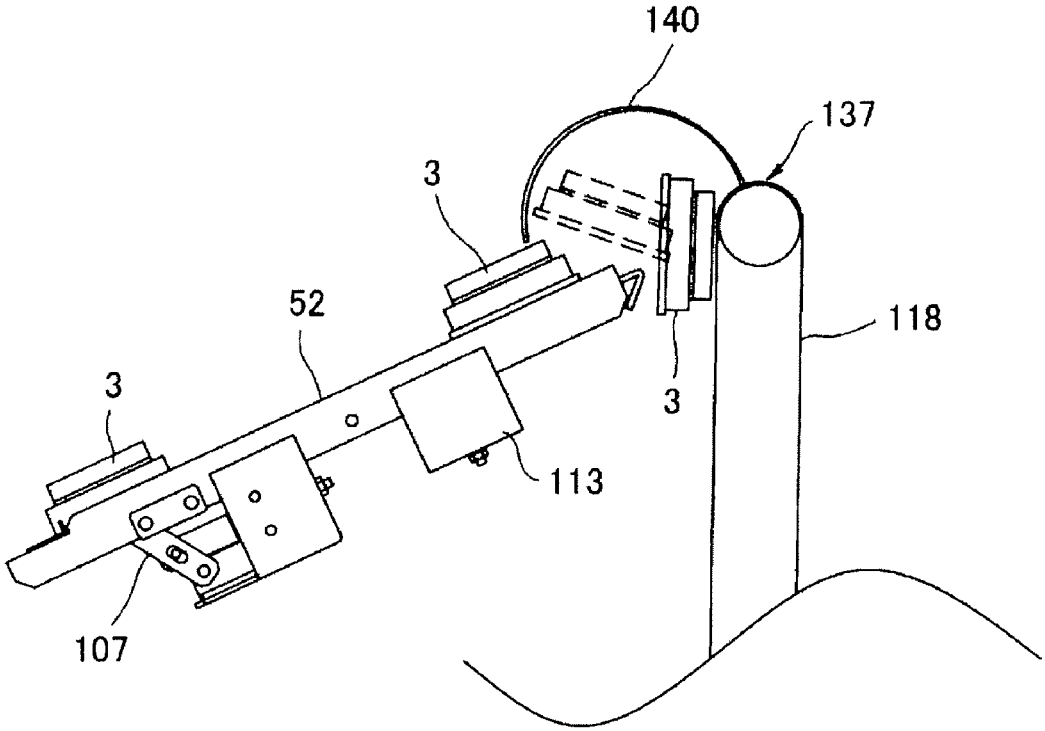
FIG. 21 illustrates behavior of the lid body in the transporting device when the lid body is shifted from the second conveyor to the lid placing member.

The lid body 3, which rides on the placing mount 131 in a normal position, reaches the apex portion of the second conveyor 118 and is shifted to the lid placing member 52 (53). FIG. 21 illustrates a behavior of the lid body in the transporting device when the lid body is shifted from the second conveyor to the lid placing member. When the lid body 3 reaches the apex portion 137 of the second conveyor 118, a top portion of the lid body 3 abuts the guide wall 140 provided at the apex portion 137 so that the lid body 3 tilts toward the lid placing member 52. Accordingly, the lid body 3 is placed on the inclined slide 100 of the lid placing member 52 with its open side facing down and the top surface 23 facing up.

The lid body 3 slides down due to the inclination of the inclined slide 100. However, since the stopper mechanism part 113 (see FIG. 13) is provided in the middle of the inclined slide 100, the lid body 3 is provisionally held under the action of the stopper mechanism part 113. As described above, the stopper mechanism part 113, which includes the solenoid 109 and the pin 114, enables the pin 114 to protrude over the inclined flat surface 102 to prevent the lid body 3 from further sliding down.

The lid body sensor 67, 69 (the first lid body sensor) detects whether the lid body 3 is stationary at the stopper mechanism part 113. If the lid body 3 is situated at the stopper mechanism part 113, then the first conveyor 133 and the second conveyor 118 are stopped. Further, the lid body sensor 68 (the first lid body sensor) monitors to determine whether the lid body 3 stops at the terminal mechanism part 101. If the lid body 3 remains stopped at the terminal mechanism part 101, the stopper mechanism part 113 enables the pin 114 to protrude preventing the lid body 3 from sliding down. If the lid body 3 is absent at the terminal mechanism part 101, the stopper mechanism part retracts the pin 114 to allow the lid body 3 to pass therethrough. Thus, the lid body 3 slides down along the inclined flat surface 102 (the inclined slide 100) and reaches the terminal mechanism part 101. Further, as described above, since the guide walls 103 are provided along both lateral sides of the inclined flat surface 102, the lid body 3 reaches the terminal mechanism part 101 without diverting from the inclined flat surface 102. In such a case, since the rotation preventing member 107 of the terminal mechanism part 101 of the lid placing member 52 sinks under the slit 40, it does not obstruct the movement of the lid body 3.

Figure 22:
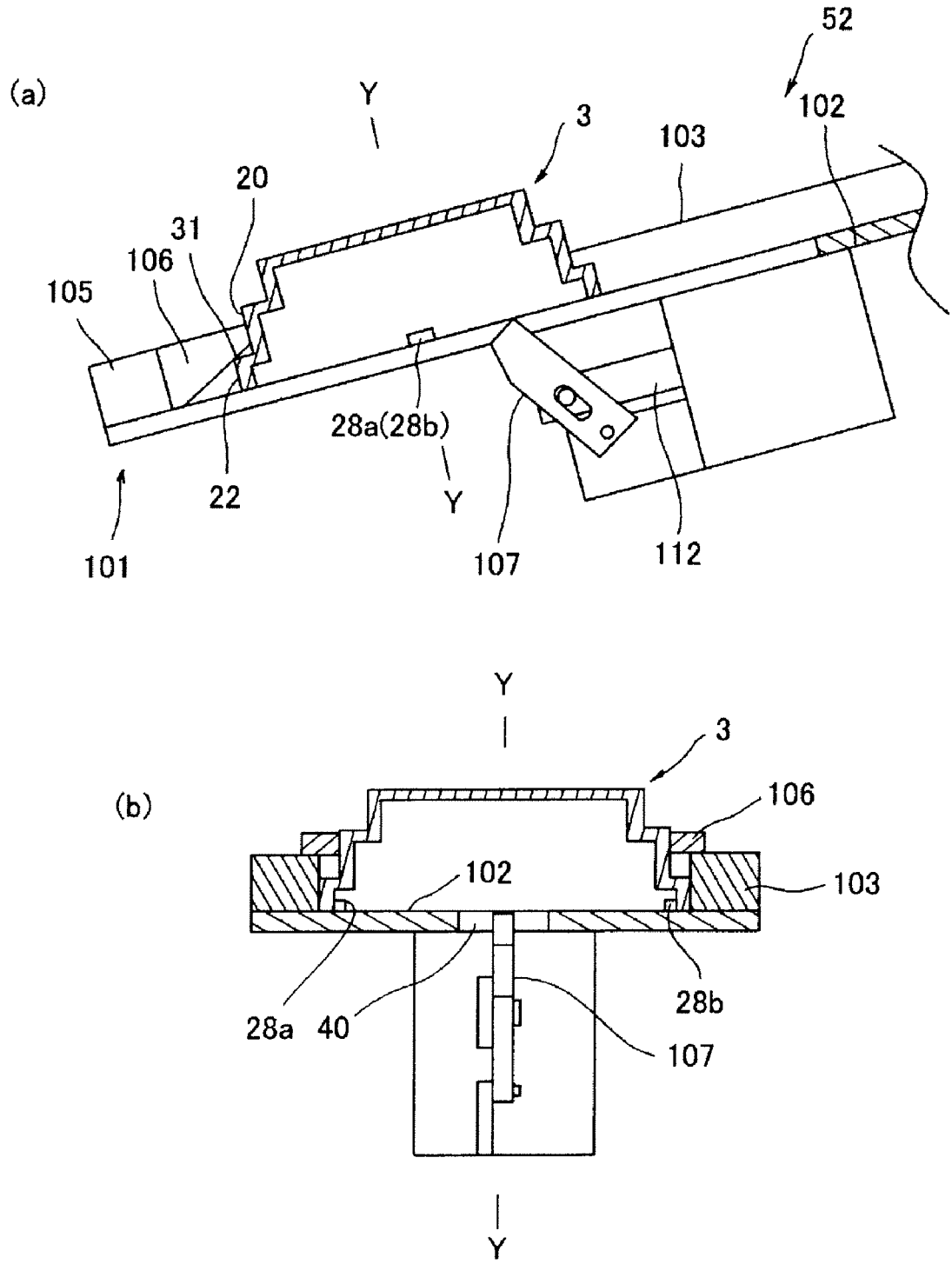
FIG. 22(*a*) is a sectioned side view showing a terminal portion of the lid placing member with the lid body placed thereon.
Figure 23:
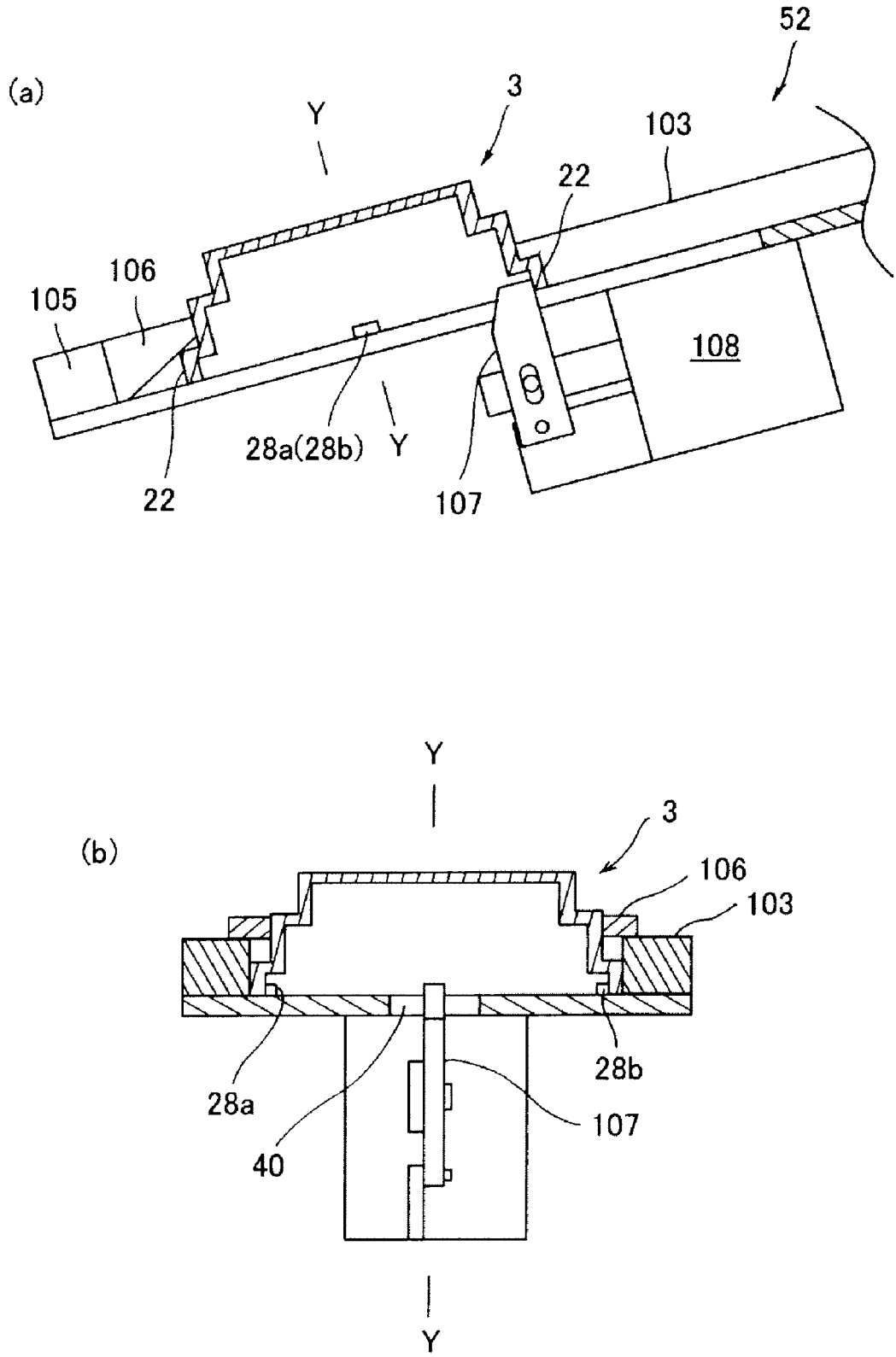
FIG. 23(*a*) is a sectioned side view showing the terminal portion of the lid placing member with the lid body placed thereon.
Figure 24:
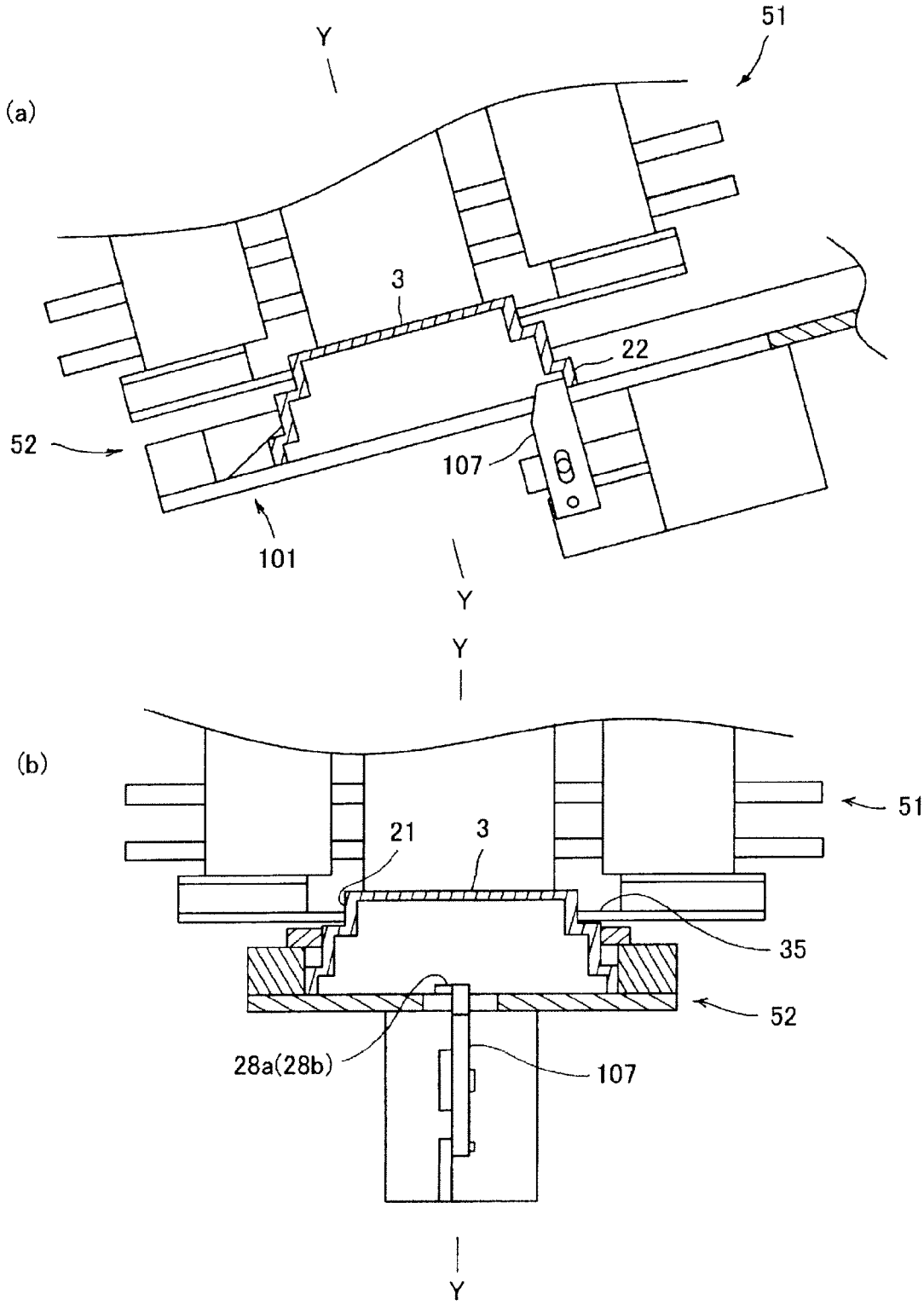
FIG. 24(*a*) is a sectioned side view showing the terminal portion of the lid placing member with the lid body placed thereon.
Figure 25:
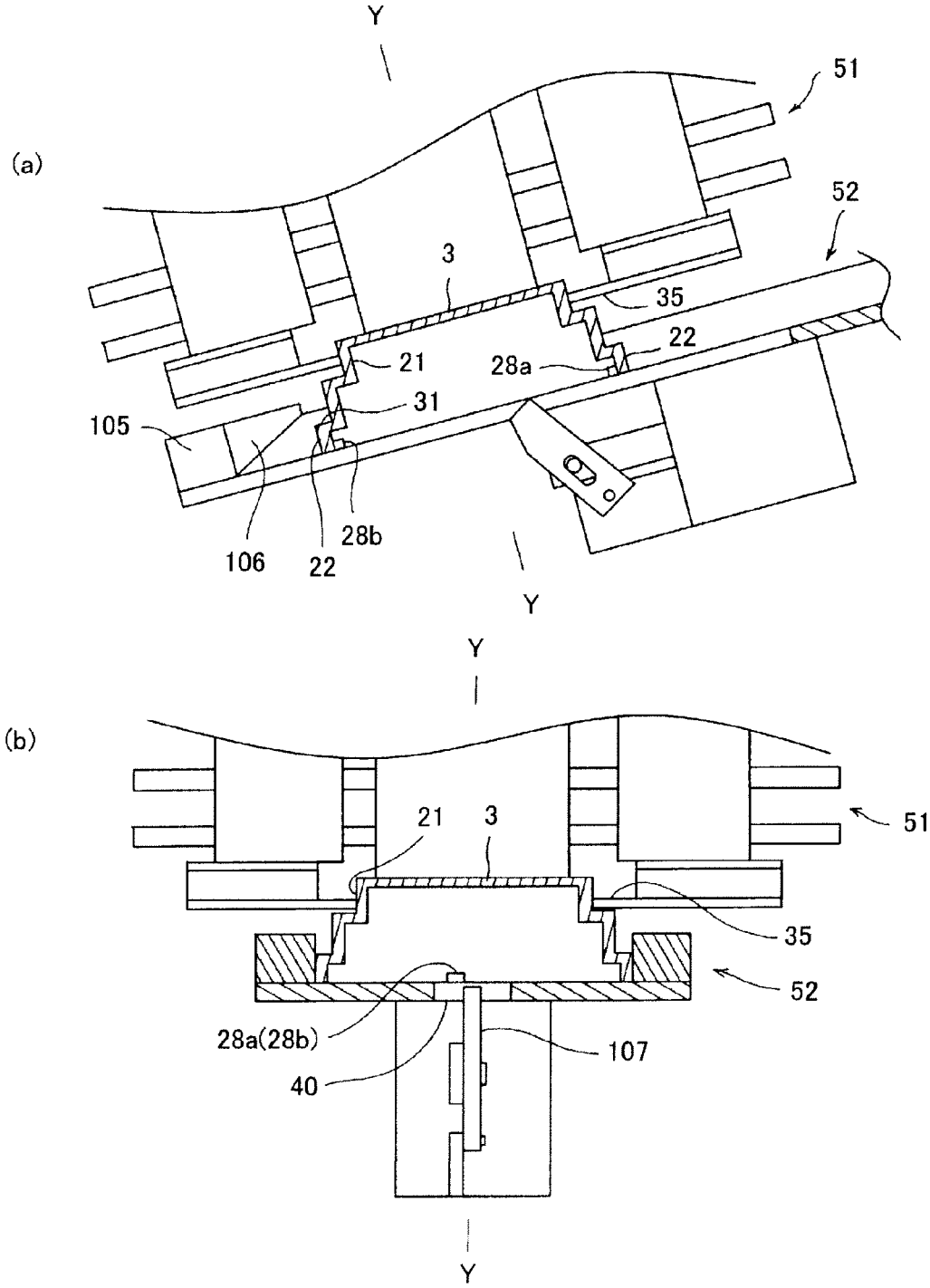
FIG. 25(*a*) is a sectioned side view showing the terminal portion of the lid placing member with the lid body placed thereon.
Figure 26:
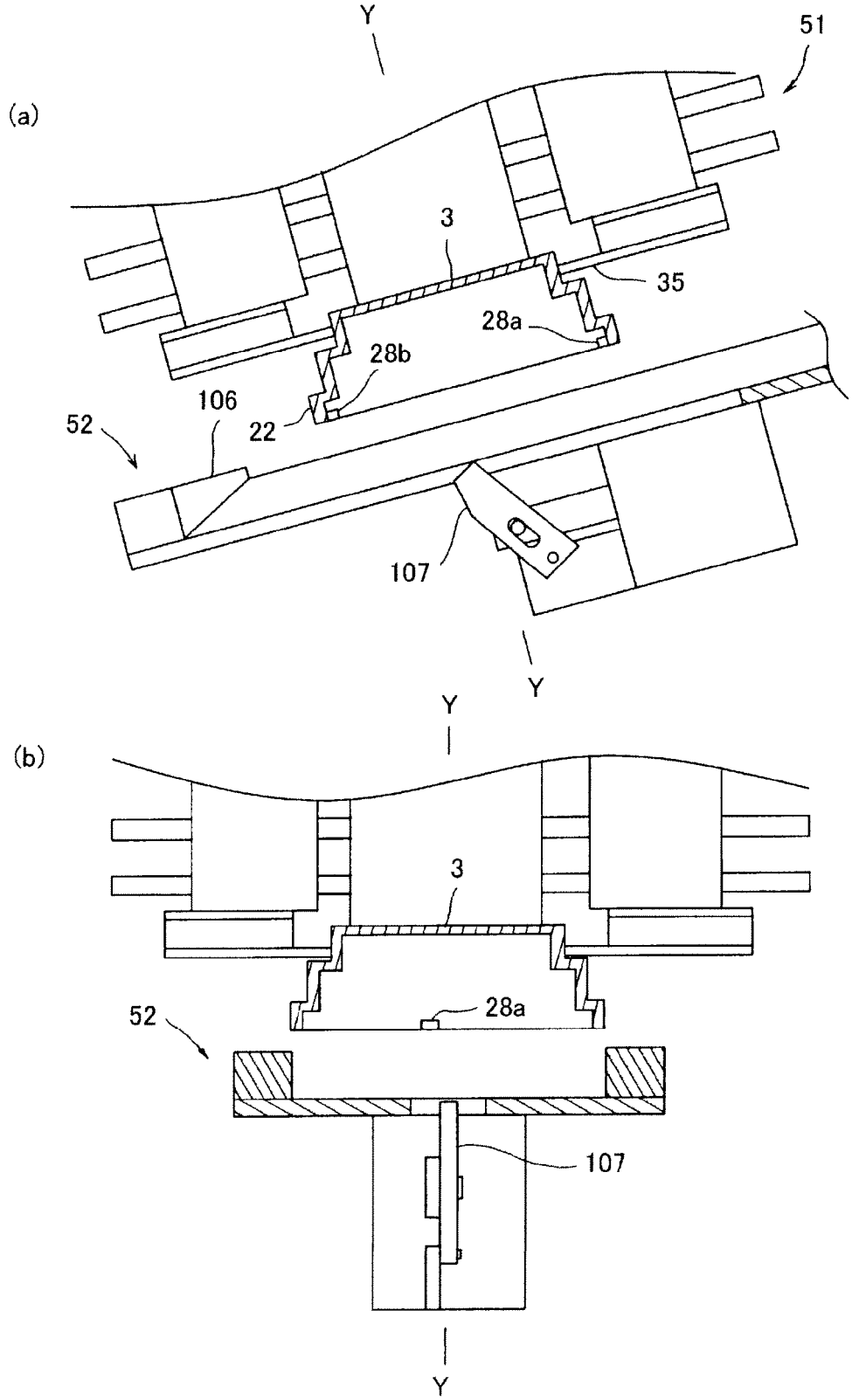
FIG. 26(*a*) is a sectioned side view showing the terminal portion of the lid placing member with the lid body placed thereon.
Figure 27:
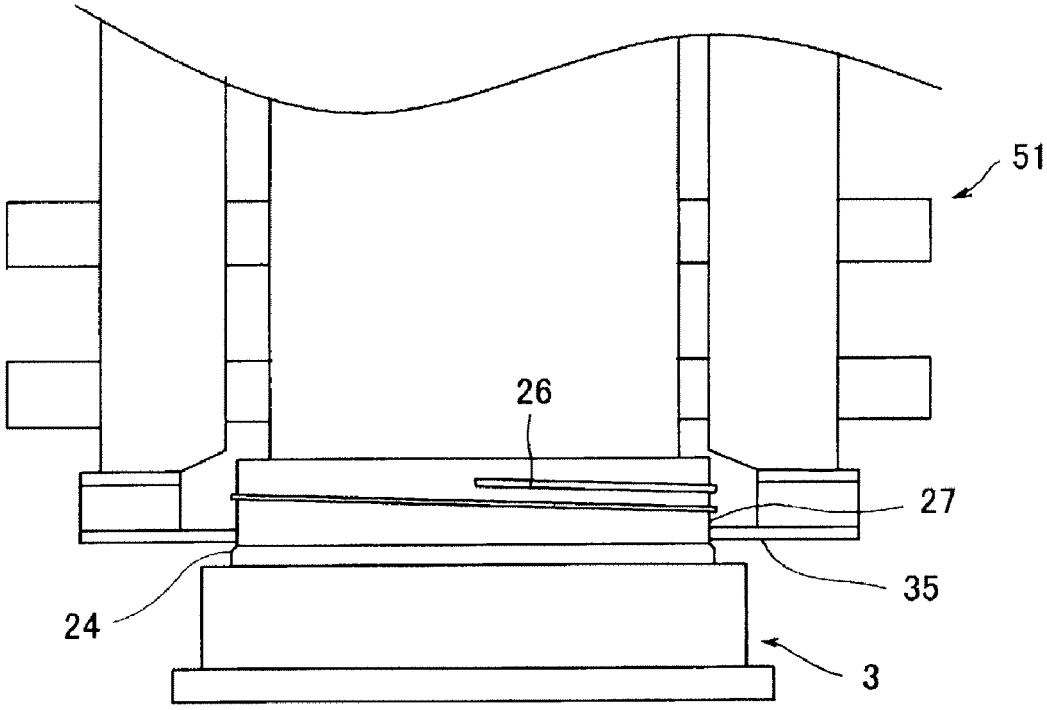
FIG. 27 is a front view of the vial lid fastening device with the chuck claws of the lid rotating device (a lid rotating and fastening means) grasping the lid body.

FIG. 22(*a*), FIG. 23(*a*), FIG. 24(*a*), FIG. 25(*a*) and FIG. 26(*a*) are partially sectioned side views showing the terminal portion of the lid placing member with the lid body placed thereon. FIG. 22(*b*), FIG. 23(*b*), FIG. 24(*b*), FIG. 25(*b*) and FIG. 26(*b*) are sectioned front views of the terminal portion of the lid placing member with the lid body placed thereon. These figures show the behavior of the lid placing member and the lid body in the terminal portion of the lid placing member. FIG. 27 is a front view of the vial lid fastening device with the chuck claws of the lid rotating device (the lid rotating and fastening means) grasping the lid body. The stepped section holder 105 is provided at the terminal mechanism part 101 and a side of the larger-diameter section 20 of the lid body 3 is brought into contact with the stepped section holder 105. Further, as shown in FIG. 22(*a*), the stepped section 31, which is between the extended-diameter section 22 and the larger-diameter section 20, is fitted to a generally U-shaped portion of the stepped section holder 105 (the space 106*a* defined in the terminal mechanism part 101). Thus, the abutment member 106 of the stepped section holder 105 is situated on the stepped section 31, thereby preventing the lid body 3 from floating upward. However, a little gap exists between the stepped section 31 of the lid body 3 and the abutment member 106 of the stepped section holder 105. In addition, a little gap exists between the outer periphery of the lid body 3 and the guide walls 103. Thus, the lid body is allowed to rotate. That is, the lid body 3, which engages the stepped section holder 105 of the terminal mechanism part 101, is prevented from floating upward, but is permitted to rotate. Furthermore, the guide walls 103 of the lid placing member 52, which is located beside lateral sides of the lid body 3, prevents the lid body 3 from oscillating and turning.

When the lid body 3 reaches the terminal mechanism part 101 and the stepped section 31 of the lid body engages the stepped section holder 105, as shown in FIGS. 23(*a*) and 23(*b*), the solenoid 108 of the terminal mechanism part 101 actuates to erect the rotation preventing member 107 and the leading portion of the rotation preventing member 107 protrudes upwardly through the slit 40. The leading portion of the rotation preventing member 107 protrudes to a position corresponding to the extended-diameter section 22 of the lid body 3. That is, the rotation preventing member 107 protrudes from the placing surface of the lid placing member 52 into the concave portion of the lid body 3, thereby forming an obstruction in the position corresponding to the extended-diameter section 22.

Along with the above-described operations, the lid rotating device (the lid rotating and fastening means) 51 is operated to move the chuck claws 35 of the rotating device body 34 toward the lid body 3. Specifically, the lifting and lowering motor 90 is operated to lift up the lifting and lowering table 33 and thus to move the rotating device body 34 to a lifted position. Further, at the same time, the tilting motor 85 provided at the exterior frame 83 is operated to tilt the rotating device body 34 and have the rotating device body 34 be positioned above the lid body 3. Further, as for the tilting angle of the rotating device body 34, the sensor 97 detects a position of the rotation position detecting indication member 93. When the rotating device body 34 moves right above the lid body 3, tilting stops.

Subsequently, as shown in FIGS. 24(*a*) and 24(*b*), the rotating device body 34 is lowered and, at the same time, the chuck claws 35 are opened in order to grasp the lid body 3. A portion of the lid body, at which the chuck claws 35 grasps the lid body 3, is the flat-surfaced portion 27 of the outer periphery of the lid body 3, as shown in FIG. 27. That is, the lid body 3 used in this embodiment has a stepped exterior contour. Thus, the lid body includes the larger-diameter section 20 and the smaller-diameter section 21. And, the outer peripheral thread of lid 26 is provided circumferentially at the protruding end portion of the smaller-diameter section 21. Further, the small-stepped section 29 is provided between the smaller-diameter section 21 and the larger-diameter section 20. However, a section between the small-stepped section 29 and the outer peripheral thread of lid 26 is flat without any concave and convex portions. The chuck claws 35 grasp such flat-surfaced section 27.

Subsequently, the chuck claws 35 are rotated to rotate the lid body 3 as it is engaged to the stepped section holder 105 of the terminal mechanism part 101. That is, the rotating motor 86 is operated so as to rotate the rotating shaft 70 of the rotating device body 34 to thereby rotate the three chuck claws 35. In such a case, in the terminal mechanism part 101, the rotation preventing member 107 is in an upright position and thus the leading end of the rotation preventing member 107 protrudes upwardly through the slit 40. Further, the rotation preventing member 107 is allowed to protrude to the position corresponding to the extended-diameter section 22 of the lid body 3. Accordingly, in such a state, the rotation preventing member 107 becomes an obstruction contacting an inner side (the rotation regulating protrusions 28*a* or 28*b*) of the extended-diameter section 22 of the lid body 3. Further, in the lid body 3 of the vial 1 used in this embodiment, the rotation regulating protrusion (the rotation regulating part) 28*a*, 28*b* are provided on the inner surface of the extended-diameter section 22.

Accordingly, when the lid body 3 is rotated while engaged with the stepped section holder 105 of the terminal mechanism part 101, one of the rotation regulating protrusions (the rotation regulating part) 28*a*, 28*b* in the lid body 3 collides with the rotation-restricting member 107 in the lid placing member 52. At this time, since the chuck claws 35 grasp the flat-surfaced section 27 of the lid body 3 with a certain force, a torque is transferred to the lid body 3 via a frictional force between the chuck claws 35 and the flat-surfaced section 27 of the lid body 3. Thus, the lid body 3 is rotated and therefore the rotation regulating protrusion (the rotation regulating part) 28*a*, 28*b* collides with the rotation-restricting member 107 of the lid placing member 52. And, if the torque for rotating the lid body 3 exceeds a certain value, then the chuck claws 35 slip and fail to transmit torque any longer.

Consequently, the lid body 3 stops its rotation as the rotation regulating protrusion (the rotation regulating part) 28*a*, 28*b* is brought into contact with the rotation preventing member 107, thereby performing position determination in a rotation direction relative to a central axis Y-Y of the lid body. That is, a position in a rotation direction relative to the central axis Y-Y of the lid body 3 is fixed. The chuck claws 35 are rotated half way at maximum to rotate the lid body 3 and then are stopped. When the chuck claws 35 stop, the solenoid 108 of the terminal mechanism part 101 is actuated to retract the rotation-restricting member 107 into the slit 40. With the above-described serial operations, the position determination in a rotation direction relative to the central axis Y-Y is performed with reference to the rotation regulating protrusions (the rotation regulating part) 28*a*, 28*b* and such position is fixed. Further, as for timing for stopping the rotation of the chuck claws 35, it can be considered to count the number of rotations, or to measure the rotation time to stop the rotation when a predetermined time elapses.

Figure 28:
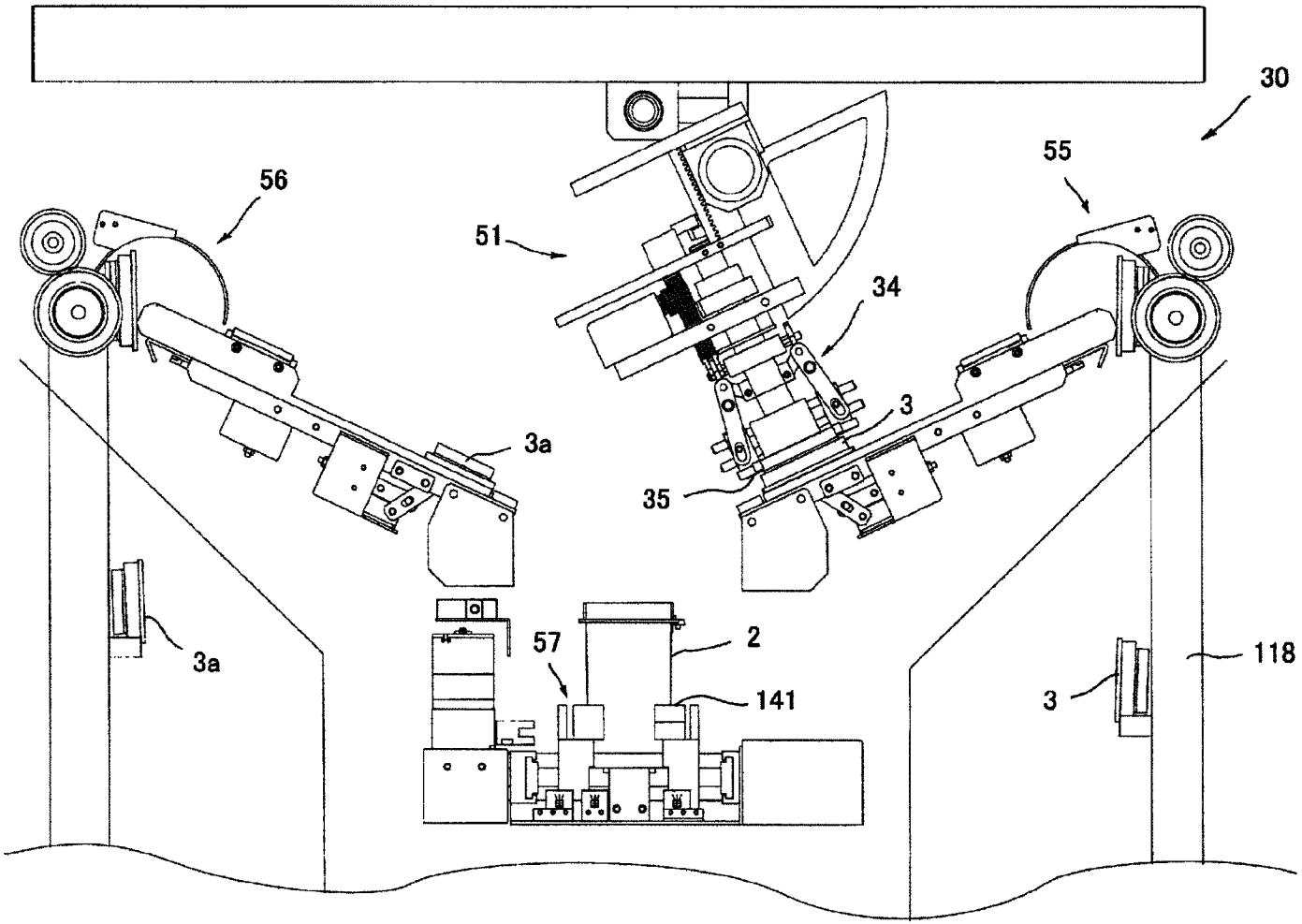
FIG. 28 is a front view of the vial lid fastening device when the chuck claws of the lid rotating device (the lid rotating and fastening means) grasps the lid body and is on the verge of picking up the lid body.

Subsequently, the lid rotating device (the lid rotating and fastening means) 51 performs an operation of separating the lid body 3 from the stepped section holder 105 of the terminal mechanism part 101. Specifically, the lid rotating device (the lid rotating and fastening means) 51 is further tilted while grasping the lid body 3, thereby moving the lid body 3 upstream of the inclined flat surface 102 as shown in FIG. 25(*a*). As a result, the stepped section 31 of the lid body 3 is separated from the stepped section holder 105 (the abutment member 106) of the terminal mechanism part 101. FIG. 28 is a front view of the vial lid fastening device when the chuck claws of the lid rotating device (the lid rotating and fastening means) grasps the lid body and is on the verge of picking up the lid body.

Figure 29:
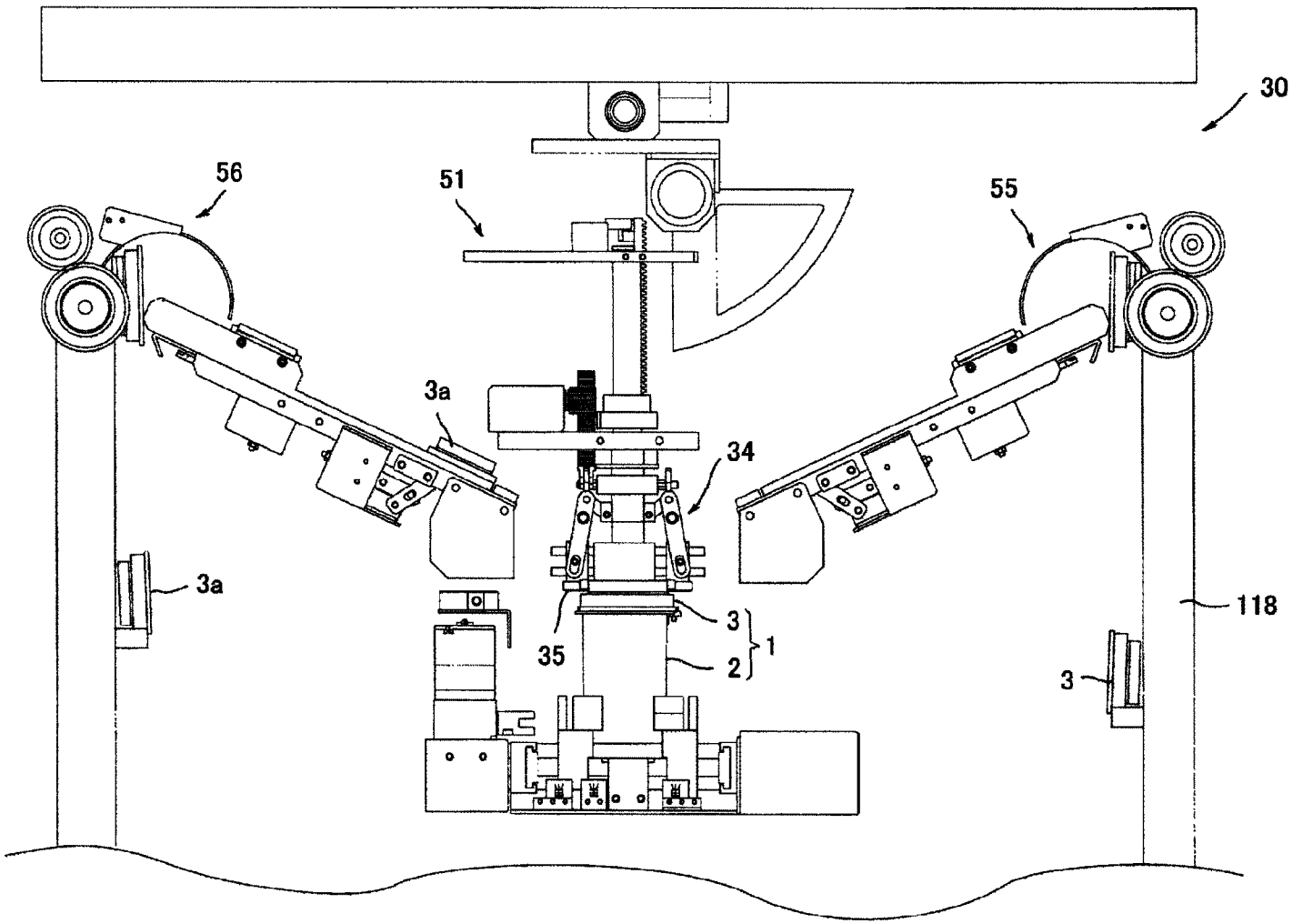
FIG. 29 is a front view of the vial lid fastening device, wherein the chuck claws of the lid rotating device (the lid rotating and fastening means) grasp the lid body and bring the same into contact with the vial body.

As shown in FIGS. 26(*a*), 26(*b*) and 28, the rotating device body 34 is lifted up without further rotating the chuck claws 35, thereby moving the lid body 3 away from a surface of the inclined flat surface 102 and thus completely separating the lid body 3 from the lid placing member 52. Subsequently, the rotating device body 34 is tilted without rotating the chuck claws 35 to return to its vertical position as shown in FIG. 29 that will be described below.

Further, the lid body sensor 48 (a third lid body sensor) is provided at the vial lid fastening device 30. The lid body sensor 48 detects the lid body 3 grasped by the chuck claws when the lid rotating device 51 goes into a vertical position. If the lid body 3 is not detected, it is assumed that the lid body 3 was removed and fell off the chuck claws while on the inclined slide 100. Furthermore, the lid body sensor 48 issues a detection error signal, thereby allowing an operator to be aware of abnormality and avoiding malfunction to be caused by the fallen lid body 3. Moreover, it can be detected whether the lid rotating device 51 grasps the lid body 3 even when a power source for the vial lid fastening device 30 is turned OFF for any reason and then is supplied again. The lid body sensors 67, 69 and 68 provided in the lid placing member 52, 53 will be described later.

Along with the above-described serial operations, the vial body 2 of the vial 1 is filled with a predetermined number of tablets, and the vial body 2 is transported by the vial body holding and supplying device 57 to wait in a predetermined position. Specifically, when the rotating device body 34 returns to its base position, the vial body 2 waits just below the rotating device body. Further, the vial body 2 becomes stationary in the predetermined position (a position in a rotation direction) as a position determination of the vial body 2 is performed with reference to, for example, the holding frame 12 or the engaging claw 11. That is, when the lid body 3 is mounted on the vial body 2, the position of the vial body 2 in the rotating direction relative to its central axis that is coaxial with the central axis Y-Y of the lid body 3 is determined with reference to the holding frame 12 or the engaging claw 11 and then the approach of the lid body 3 is waited. For example, relative to the position in a rotation direction (which is defined as described above) of the lid body 3 that approaches from above, the position in a rotation direction of the waiting vial body 2 is determined such that when both of them are brought into contact with each other and are relatively rotated thereafter, a beginning end of the thread of the vial body 2 (the outer peripheral thread of vial 6) and a beginning end of the thread of the lid body 3 (the inner peripheral thread of lid 25) engages each other at a rotation angle of less than 15 degrees.

The rotating device body 34 is lowered in the vertical position without rotating the chuck claws 35 to mate the grasped lid body 3 with the vial body 2. FIG. 29 is a front view of the vial lid fastening device, wherein the chuck claws of the lid rotating device (the lid rotating and fastening means) grasp the lid body and move it into contact with the vial body. As such, the position in rotation direction of the lid body 3 is determined with reference to the rotation regulating protrusions (the rotation regulating part) 28*a*, 28*b*. Also, the lid body is joined to the vial body 2 while maintaining such a position as it is. Further, the position in rotation direction of the opposite vial body 2 is also determined. Thus, when both of them are joined to each other, a relative position in a rotation direction relative to the central axis Y-Y is always fixed. Preferably, such a relative position is a position wherein the beginning end of the outer peripheral thread of vial 6 of the vial body 2 and the beginning end of the inner peripheral thread of lid 25 are close to each other. More preferably, such a relative position is a position wherein when the lid body 3 is rotated, the beginning end of the inner peripheral thread of lid 25 and the beginning end of the outer peripheral thread of vial 6 of the vial body 2 are brought into contact with each other at a rotating angle of less than 15 degrees.

Subsequently, the chuck claws 35 of the rotating device body 34 are rotated. Thus, the lid body 3 is rotated relative to the vial body 2 and the inner peripheral thread of lid 25 and the outer peripheral thread of vial 6 and engages to each other, thereby mounting the lid body 3 to the vial body 2. If the inner peripheral thread of lid 25 and the outer peripheral thread of vial 6 are fastened up to their terminal ends, then the rotation regulating protrusion 28*a*, 28*b* of the lid body 3 engages the engaging claw 11 of the vial body 2.

Since the chuck claws 35 grasp the flat-surfaced section 27 of the vial body 3 with a certain force, as described above, a torque is transferred to the lid body 3 by means of a frictional force between the chuck claws 35 and the flat-surfaced section 27. Thus, when the lid body 3 is rotated and then completely closed, the torque for rotating the lid body 3 exceeds a certain value and the chuck claws 35 slip and fail to transmit torque any longer. Accordingly, there can be no damage to the lid body 3.

When fastening of a lid is completed, the chuck claws 35 are opened to release the lid body 3, and the rotating device body 34 is lifted up and returns to its original position to start to tilt again and prepare for rotating the next lid body 3. Along with the above-described operations, the stopper mechanism part 113 situated upstream of the lid placing member 52 discharges a new lid body 3 and it slides down the lid body 3 and moves to the terminal mechanism part 101. Thereafter, the lid rotating device (the lid rotating and fastening means) 51 and the lid placing member 52, 53 repeat the above-described serial operations.

The vial 1 with the lid body 3 mounted thereto is discharged to a predetermined position by the vial discharging device 58. Specifically, the vial discharging device 58 lifts or lowers the lifting and lowering table 164 to adjust the height of the arms 150 to the position of the vial 1 and advances the arms 150 to grasp the vial 1. Subsequently, the vial discharging device retracts the arms 150 and rotates the rotating base 161 to reverse the orientation of the arms 150. Subsequently, the vial discharging device actuates the lifting and lowering table 164 to adjust the height of the vial 1 to a height of a keeping shelf 202 (shown in FIG. 30 described below), and advances the arms 150 to put the vial 1 into the keeping shelf 202, and then opens the arms 150 to place the vial 1 thereto. Then, the vial discharging device 58 returns to a predetermined standby position.

Figure 30:
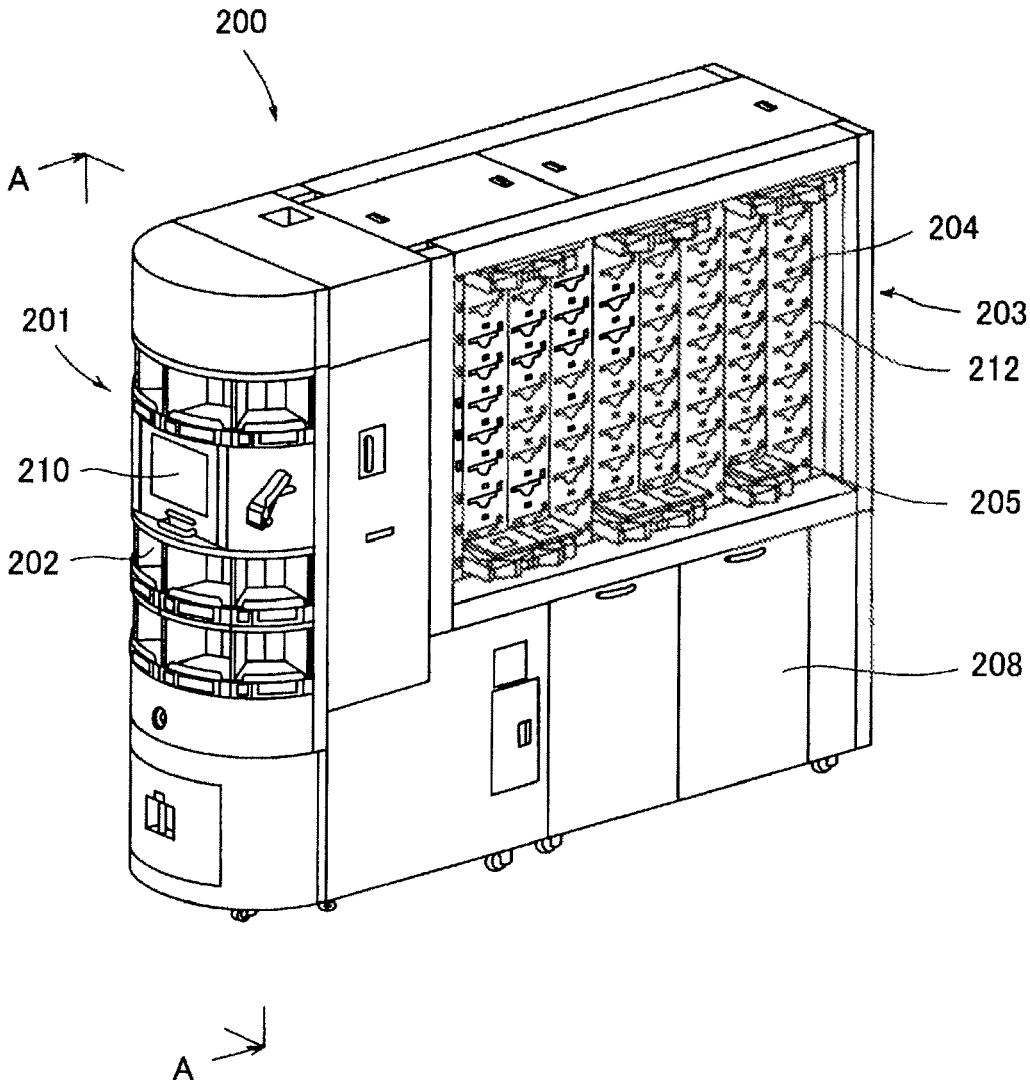
FIG. 30 is a perspective view of a medicine accommodating and removing device.

Next, the medicine accommodating and removing device 200 with the above-described vial lid fastening device 30 will be described. FIG. 30 is a perspective view of the medicine accommodating and removing device. The medicine accommodating and removing device 200 according to this embodiment has functions of selecting a particular tablet from various kinds of tablet groups and filling a vial with such a tablet. The medicine accommodating and removing device 200 according to this embodiment has a keeping shelf 202, a medicine supplying section 203, a vial body accommodating section 208, a vial conveying section (not shown) and a vial lid fastening section 201. The above-described vial lid fastening device 30 is built in the vial lid fastening section 201. FIG. 7 that was described above corresponds to a view of the medicine accommodating and removing device opened along the plane A-A of FIG. 30. The keeping shelf 202 serves to provisionally place the vial 1, which is filled with tablets, and to which the lid is fastened. The medicine accommodating and removing device 200 is connected to a superordinate system such as a host computer (not shown). The host computer previously stores medicine prescription data or a patient data. The medicine accommodating and removing device 200 of the present invention has the functions of writing down a label, which depicts a patient's name, a medicine name, a figure of the medicine, etc., according to the data from the host computer and applying the same to the vial body 2. Further, the medicine accommodating and removing device 200 dispenses corresponding medicine according to the data from the host computer and then fills the vial body having the label applied thereon with the medicine. Furthermore, the medicine accommodating and removing device is configured to include a camera for photographing the vial body (for example, a CCD) and to display a label applied to the vial body 2 that is photographed by the camera and the medicine in a monitor 210 so that an operator can check them at a glance.

The medicine supplying section 203 includes a medicine reservoir and a medicine dispensing means. A large number of container attachments 204 are provided in the medicine supplying section 203. And, a medicine container 205 is attached to each of the container attachments 204. FIG. 30 shows that the medicine containers 205 are attached only in a lowermost row. Actually, however, the medicine containers 205 are used as attached throughout a total area of the medicine supplying section 203. Each of the medicine containers 205 accommodates different kinds of medicines respectively. The container attachment 204 constitutes a medicine dispensing means. The container attachment functions to remove a predetermined quantity of medicine from the medicine container 205 and then discharges the same to the vial conveyed at a back side of the container attachment.

The vial body accommodating section 208 allows for vial bodies as tablet containers. In the medicine accommodating and removing device 200 of this embodiment, the vial body 2 is transported near the back side of the container attachment 204 and then the vial body 2 is filled with tablets. Specifically, a vial transporting device (not shown) is built in the medicine accommodating and removing device 200. The vial transporting device is configured to remove the vial body 2 from the vial body accommodating section 208 and transport the vial body 2 near the back side of a predetermined container attachment 204 in the medicine supplying section 203. Further, before the vial body 2 is transported to the container attachment 204, the label in which a patient's name, a medicine name, etc. are written down is applied to the vial body 2. The container attachment 204 removes the medicine in the medicine container 205 and discharges the same from its back side, thereby supplying tablets to the vial body 2.

Thereafter, the vial body 2 filled with the tablets is transported to the vial lid fastening section 201. The vial lid fastening section 201 includes the above-described vial lid fastening device 30. The vial lid fastening section 201 mounts the lid body 3 to the vial body 2 and places the vial 1 on the keeping shelf 202 by means of the vial discharging device 58 after the lid fastening. That is, the vial 1, which is filled with predetermined medicine and is completely sealed by the lid body 3, is placed on the keeping shelf 202. With the above-described serial operations, the medicine filling operation and lid fastening operation are complete.

Next, performing lid fastening for differently-sized vials using the same vial lid fastening device will be described. The vial lid fastening device 30 shown in FIG. 7 includes the two lid placing members 52, 53. Hereinafter, it is assumed that the lid body 3*a* of a relatively larger diameter is fed to one of the lid placing member 52 and the lid body 3*b* of a relatively smaller diameter is fed to the other the lid placing member 53.

Figure 31:
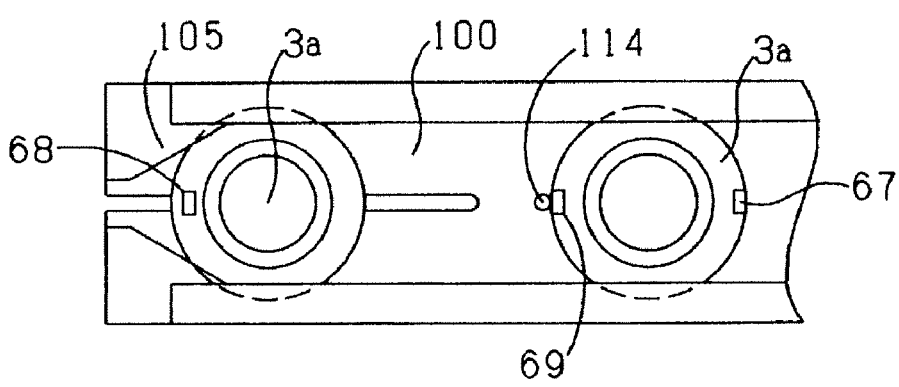
FIG. 31(*a*) is a partial plan view of an inclined slide of the lid placing member wherein the lid body of a larger diameter is placed thereon.
Figure 31:
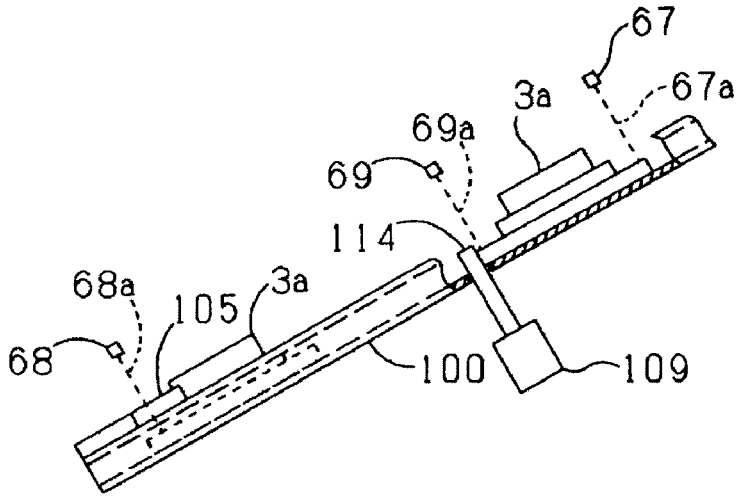
Figure 31:
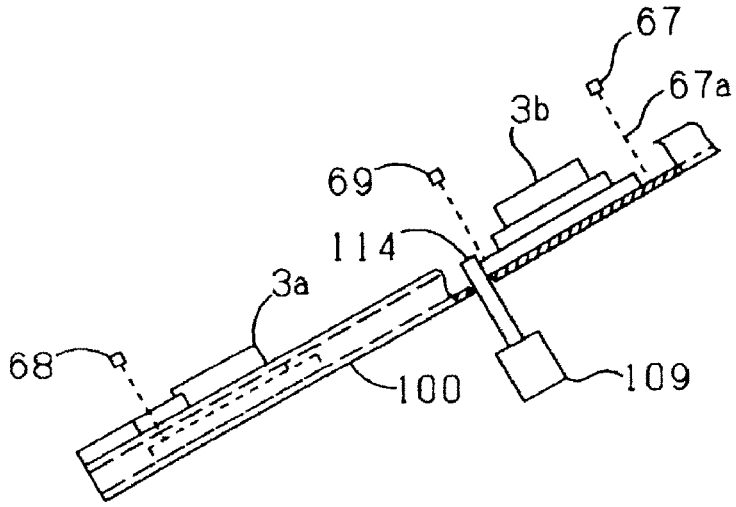

First, the lid placing member 52, to which the lid body 3*a* of a relatively larger diameter is fed, will be described. The lid placing member 52 is located on the left side in FIG. 7 and has the above-described constitution. The inclined slide 100 provided in the lid placing member 52 is shown in FIG. 31. FIG. 31(*a*) is a partial plan view of the inclined slide of the lid placing member wherein the lid body of a larger diameter is placed thereon. FIG. 31(*b*) is a partial side view of the inclined slide with a portion thereof broken away wherein the lid body of a larger diameter is placed thereon. FIG. 31(*c*) is a partial side view of the inclined slide with a portion thereof broken away wherein the lid body of a smaller larger diameter is placed thereon. As shown in FIG. 31(*b*), the inclined slide 100 is inclined. Strictly speaking, FIG. 31(*a*) is a view that is taken vertically relative to the inclined flat surface. However, for ease of explanation, it is referred to as a plan view.

As shown in FIGS. 31(*a*) and 31(*b*), the lid body 3*a* of a larger diameter is fed to the inclined slide 100 of the lid placing member 52. The three sensors 67, 68, 69 are provided at the inclined slide 100 shown in FIG. 31(*a*). The three sensors are optical sensors that use an infrared ray, for example.

The lid body sensor 68 detects the presence or absence of the lid body 3*a* that stands by in the stepped section holder 105 so as to be grasped by the lid rotating device 51 (see FIG. 7). Further, the lid body sensor 67 and the lid body sensor 69 detect the presence or absence of the lid body 3*a* of a predetermined diameter that is brought into contact with the pin 114 of the stopper mechanism part 113 (see FIG. 11) to thereby be prevented from sliding down.

That is, the lid body sensor 68 is disposed near the lower end of the inclined slide 100, while the lid body sensor 69 is disposed near the pin 114 (i.e., an upstream side). The lid body sensors 68, 69 confirm the presence of the lid body 3*a* by irradiating detection rays 68*a*, 69*a* to a lower side of the inclined lid body 3*a*. Meanwhile, the lid body sensor 67 is disposed in a position wherein it can irradiate a detection ray 67*a* to an upper side of the inclined lid body 3*a* that is in contact with the pin 114. Accordingly, the lid body 3*a* that is stopped by being in contact with the pin 114 is detected by the two lid body sensors 67, 69.

The lid body 3*a* of a relatively larger diameter is fed to the lid placing member 52 (see FIG. 7). However, in a very rare case, the lid body 3*b* of a relatively smaller diameter may be mixed. As shown in FIG. 31(*c*), when the lid body 3*b* of a relatively smaller diameter goes down the inclined slide 100, the lid body sensor 69 can detect the lid body 3*b* that is stopped by the pin 114, while the lid body sensor 67 cannot detect the lid body 3*b* since the detection ray 67*a* of the lid body sensor 67 does not reach the lid body 3*b*. As such, it can be detected that the lid body 3*b* of a relatively smaller diameter is situated on the inclined slide 100.

That is, a lid body 3*a* of a relatively larger diameter can be detected by both the lid body sensor 67 and the lid body sensor 69 when it is stopped by the pin 114. A lid body 3*b* having a smaller diameter can be detected by only the lid body sensor 69. Accordingly, when only the lid body sensor 67 detects an object, it can be considered that an object other than the lid body 3*a* (e.g., the lid body 3*b*) is in contact with the pin 114. Thus, an operator can be aware that an abnormality occurred on the inclined slide 100 and can eliminate the foreign object (e.g., the lid body 3*b* of a smaller diameter) from the inclined slide 100. When an object in contact with the pin 114 is a desired lid body 3*a* and when the lid body 3*a* situated below (in the left side) is taken away by the lid rotating device 51 (see FIG. 7) and is no longer detected by the lid body sensor 68, the solenoid 109 is actuated to retract the pin 114 from the inclined flat surface 102 in order to allow lid body 3*a* to slide down.

As described above, in order to hold the lid body 3*a* that corresponds to the vial body 2 in the normal position by the lid rotating device 51 (see FIG. 7), the detection results from the first lid body sensors 67, 69, 68, the second lid body sensors 44, 45, and the third lid body sensor 48 are used.

That is, the second lid body sensor 44 (the lid body overfilling sensor) and the second lid body sensor 45 (the lid body remainder sensor) determine whether the lid bodies in the first lid body reservoir 115 is within a predetermined range. When lid body overflow sensor 44 detects that the stock of the lid bodies exceeds the predetermined range, an operator is allowed to be aware of such a case through an alarm (not shown) and removes a portion of the lid bodies 3*a* in the first lid body reservoir 115 through the opening 125 (see FIG. 7) to resolve such overflow conditions. On the contrary, if the lid body remainder sensor 45 detects that the stock of the lid bodies 3*a* in the first lid body reservoir 115 does not amount to a predetermined quantity (i.e., it is not within the predetermined range), the lid bodies 3*a* are fed through the lid body feeding inlet 41 in order to increase the stock of the lid bodies in the first lid body reservoir 115 to the extent that the lid bodies do not overfill.

Subsequently, the first conveyor 133 and the second conveyor 118 are driven to convey the lid bodies 3*a* to the inclined slide 100 one by one. Further, the vertical orientation (position of the inside and the outside) of the lid body is adjusted during the conveyance so that when the lid body is placed on the inclined slide 100 (the inclined flat surface 102), the smaller-diameter section 21 faces upward (the larger-diameter section faces downward). That is, the lid body 3*a*, the inside and outside of which faces a reverse direction on the second conveyor 118, is allowed to fall off during the conveyance or to be withdrawn to the first lid body reservoir 115 through the opening 125.

Nonetheless, the lid body 3*a* having a reverse orientation may remain on the second conveyor 118 and, on rare occasions, such a lid body 3*a* may be placed on the inclined slide 100 with its top and bottom facing a reverse direction. Further, on rare occasions, a different type of a lid body may be placed on the inclined slide 100. As described above, it can be judged based on the detection result of the first lid body sensors 67, 69 whether the lid body 3*a* correspond to any vial body is placed on the inclined slide 100 with a predetermined orientation (e.g., with the smaller-diameter section 21 facing upward).

Figure 32:
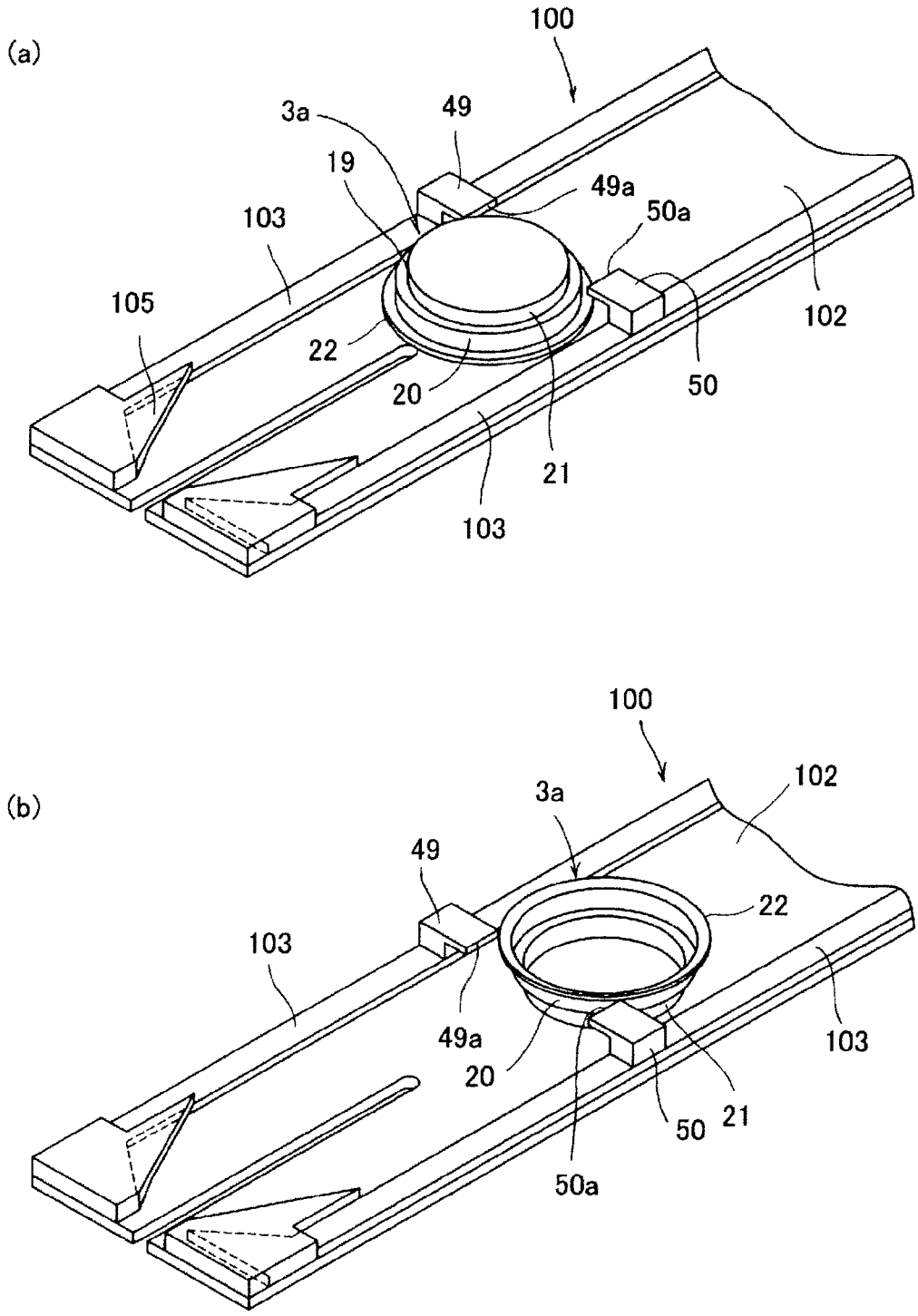
FIG. 32(*a*) is a perspective view of the inclined slide wherein the lid body is normally placed thereon.

Further, to cope with a case wherein a lid body larger than the lid body 3*a* is placed on the inclined slide 100, projecting members (projecting part) 49, 50 are provided at the inclined slide 100 as shown in FIG. 32(*b*). FIG. 32(*a*) is a perspective view of the inclined slide when the lid body is normally placed thereon. FIG. 32(*b*) is a perspective view of the inclined slide when the lid body is placed with its top and bottom (its inside and outside) facing a reverse direction.

As shown in FIG. 32(*a*), the projecting members 49, 50 are disposed on opposite guide walls 103 of the lateral sides of the inclined slide 100 to oppose each other. The projecting members 49, 50 have leading end portions 49*a*, 50*a* projecting toward the center of the inclined flat surface 102 of the inclined slide 100.

The projecting members 49, 50 are disposed on the guide walls 103. The projecting members are configured such that a height of the leading end portion 49*a* (50*a*) from the inclined flat surface 102 is higher than the large-stepped section 19 and generally equals a height of the smaller-diameter section 21. Further, a gap between the leading end portion 49*a* and the leading end portion 50*a* is larger than a diameter of the smaller-diameter section 21 of the lid body 3*a* (see FIG. 2) and smaller than a diameter of the extended-diameter section 22 (or the larger-diameter section 20). Thus, as shown in FIG. 32(*a*), if the lid body 3*a* is placed on the inclined slide 100 with the extended-diameter section 22 lying below, then the lid body 3*a* can pass by the projecting members 49, 50. On the contrary, as shown in FIG. 32(*b*), if the lid body is placed on the inclined slide with the extended-diameter section 22 lying above, then the extended-diameter section 22 (or the larger-diameter section 20) is caught by the leading end portions 49*a*, 50*a* of the projecting members 49, 50, thereby hindering the lid body from sliding down.

In case the projecting members 49, 50 are disposed upstream of the pin 114 shown in FIG. 31, if the lid body 3*a* is placed on the inclined slide 100 with its top and bottom reversed or if any lid body having a diameter larger than the lid body 3*a* is placed on the inclined slide 100, such lid bodies cannot reach the pin 114 since they are not permitted to pass by the projecting members 49, 50, and therefore the lid body sensor 69 cannot detect the lid body 3*a* even if a predetermined time passes. Accordingly, if it is detected by the second lid body sensor (the lid body remainder sensor) 45 that a certain quantity of the lid bodies 3 is in the first lid body reservoir 115, then it can be judged that an abnormality occurred in one of the conveyance paths of the lid body 3*a*.

In such a case, if the lid body remainder sensor 45 detects a shortage of lid bodies, then it is judged that the device 30 works normally. And, when the lid bodies 3*a* are fed through the lid body feeding inlet 41 (see FIG. 7), the lid body 3*a* is placed on the inclined slide 100. Meanwhile, even if the projecting members 49, 50 are disposed downstream of the pin 114, a device malfunction (e.g., catch, jam, pinch, etc.) or a lid body shortage can be judged based on the detection results of the lid body sensor 68 and the lid body remainder sensor 45. In this embodiment, the catch prevention sensors 46, 47 are provided at the horizontal section 135 of the second conveyor 118. Thus, when those sensors detect a catch of the lid body (or a foreign object), an operator eliminates such a caught object. Meanwhile, if the first lid body sensors 68, 69, 67 do not detect the lid body and the catch prevention sensors 46, 47 do not detect a pinch of a foreign object, then the lid body 3*a* is supplied to the inclined slide 100 from the lid body reservoir 105 through the first conveyor 133 and the second conveyor 118.

As shown in FIG. 7, the vial lid fastening device 30 includes the two lid placing members 52, 53. Thus, the vial lid fastening device 30 is capable of handling different types of lid bodies through the lid placing member 52 and the lid placing member 53. For example, the lid body of a relatively larger diameter can be supplied through the lid placing member 52, while the lid body 3*b* of a relatively smaller diameter can be supplied through the lid placing member 53.

As described above, since the first lid body sensors 68, 67, 69, the second lid body sensors 44, 45, the third lid body sensor 48, and the projecting members 49, 50 are provided, faulty lid fastening, which can occur when any lid body other than a lid body corresponding to any vial body is supplied or when the lid body corresponding to any vial body is supplied with its top and bottom facing a reverse direction, can be prevented.

The invention claimed is:

1. A vial lid fastening device for targeting a vial having a vial body and a lid body and mounting the lid body to the vial body, the targeted vial including threads engaging each other at the vial body and the lid body, the lid body including a rotation regulating part engaging a portion of the vial body to regulate rotation, comprising:

a vial body holding means for holding the vial body while fixing a position in a rotation direction relative to a central axis with reference to the portion of the vial body;

a lid holding means for bringing the lid body into contact with the vial body while fixing a position in a rotation direction relative to the central axis with reference to the rotation regulating part; and a lid rotating and fastening means for relatively rotating the lid body and the vial body.

2. The vial lid fastening device of claim 1, wherein the lid body and the vial body are mated to each other and then are relatively rotated to fasten the lid body, and wherein a relative position in a rotation direction when the lid body and the vial body are mated to each other is such that when the lid body and the vial body are relatively rotated, a beginning end of the thread of the lid body and a beginning end of the thread of the vial body contact each other at a rotation angle of less than 15 degrees.

3. The vial lid fastening device of claim 1, further comprising a conveyor configured to convey the lid body to a predetermined position, the conveyor including: an erected section for holding and lifting upward the lid body situated at a bottom side; and a section having an angle of 80 degrees to 100 degrees relative to a horizontal plane at at least a portion of the erected section.

4. The vial lid fastening device of claim 1, further comprising a third lid body sensor for detecting whether the lid holding means holds the lid body.

5. A vial lid fastening device for targeting a vial having a vial body and a lid body and mounting the lid body to the vial body, the targeted vial including threads engaging each other at the vial body and the lid body, the lid body including a rotation regulating part engaging a portion of the vial body to regulate rotation, comprising:

a vial body holding means for holding the vial body while maintaining a position in a rotation direction relative to a central axis;

a lid holding means for bringing the lid body into contact with the vial body while maintaining a position in a rotation direction relative to the central axis with reference to the rotation regulating part;

a lid rotating and fastening means for relatively rotating the lid body and the vial body;

a lid placing part configured to rotatably place the lid body;

a rotation preventing member configured to contact the rotation regulating part in a predetermined rotation position; and a rotating and positioning means for rotating the lid body with a torque of a predetermined range.

6. The vial lid fastening device of claim 5, wherein the lid rotating and fastening means combines the rotating and positioning means and has a chucking function for grasping the lid body, a lifting and lowering function and a tilting function, wherein the lid body of the targeted vial has a stepped section and the lid placing part includes an inclined placing surface and a stepped section holder, wherein the lid body slides down the placing surface and the stepped section holder engages the stepped section of the lid body in a position where the lid body slides down and then stops to prevent the lid body from floating upward, and wherein the lid rotating and fastening means grasps the lid body by the chucking function and rotates the lid body and then tilts the lid body to move the lid body up in an inclination direction in order to disengage the lid body from the stepped section holder.

7. The vial lid fastening device of claim 5, wherein the lid body of the targeted vial has a concave portion and the thread and the rotation regulating part are situated on an inner periphery of the concave portion, and wherein the lid body is held on the lid placing part with the concave portion lying prone and the rotation preventing member protrudes toward and is retracted from the concave portion of the lid body at the placing surface of the lid placing part.

8. The vial lid fastening device of claim 5, further comprising a first lid body sensor for detecting whether the lid body is situated on the lid placing part.

9. The vial lid fastening device of claim 8, wherein the first lid body sensor is configured to distinguish a lid body of a diameter larger than a predetermined dimension and a lid body of a diameter smaller than the predetermined dimension.

10. The vial lid fastening device of claim 8, wherein the first lid body sensor includes a plurality of sensors.

11. The vial lid fastening device of claim 5, wherein the lid body of the targeted vial has an exterior contour of a stepped shape, whereby the lid body includes a larger-diameter section and a smaller-diameter section, wherein the smaller-diameter section has a threaded portion with the thread provided thereon and a flat-surfaced portion, and wherein the lid rotating and fastening means has a chuck part with three or more holding claws, the holding claws grasping the flat-surfaced portion.

12. The vial lid fastening device of claim 11, wherein a projecting part is provided at the lid placing part with a predetermined height, the projecting part limiting a dimension for permitting the lid body to pass therethrough, and wherein the dimension is larger than a diameter of the smaller-diameter section of the lid body and smaller than a diameter of the larger-diameter section of the lid body.

13. A vial lid fastening device for targeting a vial having a vial body and a lid body and mounting the lid body to the vial body, the targeted vial including threads engaging each other at the vial body and the lid body, the lid body including a rotation regulating part engaging a portion of the vial body to regulate rotation, comprising:

a vial body holding means for holding the vial body while maintaining a position in a rotation direction relative to a central axis;

a lid holding means for bringing the lid body into contact with the vial body while maintaining a position in a rotation direction relative to the central axis with reference to the rotation regulating part;

a lid rotating and fastening means for relatively rotating the lid body and the vial body;

a first lid body reservoir configured to stock the lid body;

a second lid body reservoir in a middle of a conveyance path wherein the lid body is conveyed from the first lid body reservoir to a predetermined location;

a first conveyor for conveying the lid body from the first lid body reservoir to the second lid body reservoir; and a second conveyor for conveying the lid body from the second lid body reservoir to the predetermined location, wherein the first conveyor is configured to remove the lid body out of the first conveyor and convey the lid body one by one and the second conveyor is configured to adjust an inside and outside position of the lid body and convey the lid body to the predetermined location.

14. The vial lid fastening device of claim 13, wherein the second conveyor includes a sharp inclination section, whereby the lid body takes an erected position at the sharp inclination section and the lid body without a normal inside and outside position falls off.

15. The vial lid fastening device of claim 13, further comprising a second lid body sensor for detecting a quantity of the lid body stocked in the first lid body reservoir.

16. The vial lid fastening device of claim 15, wherein the second lid body sensor detects whether a remainder of the lid body exceeds a predetermined quantity and/or whether a remainder of the lid body is below the predetermined quantity.

17. A medicine accommodating and removing device, comprising:

a vial body accommodating section configured to accommodate vial bodies of vials;

a medicine stocking section configured to stock different kinds of medicines;

a medicine dispensing means configured to dispense a desired medicine out of the medicine stocking section; and the vial lid fastening device according to claim 1, wherein the vial has the vial body and a lid body and includes threads engaging each other at the vial body and the lid body, the lid body including a rotation regulating part engaging a portion of the vial body to regulate rotation, and wherein the vial lid fastening device mounts the lid body to the vial body and comprises:

a vial body holding means for holding the vial body while fixing a position in a rotation direction relative to a central axis with reference to the portion of the vial body;

a lid holding means for bringing the lid body into contact with the vial body while fixing a position in a rotation direction relative to the central axis with reference to the rotation regulating part; and a lid rotating and fastening means for relatively rotating the lid body and the vial body.

18. A medicine accommodating and removing device, comprising:

a vial body accommodating section configured to accommodate vial bodies of vials;

a medicine stocking section configured to stock different kinds of medicines;

a medicine dispensing means configured to dispense a desired medicine out of the medicine stocking section; and the vial lid fastening device according to claim 5, wherein the vial has the vial body and a lid body and includes threads engaging each other at the vial body and the lid body, the lid body including a rotation regulating part engaging a portion of the vial body to regulate rotation, and wherein the vial lid fastening device mounts the lid body to the vial body and comprises:

a vial body holding means for holding the vial body while maintaining a position in a rotation direction relative to a central axis;

a lid holding means for bringing the lid body into contact with the vial body while maintaining a position in a rotation direction relative to the central axis with reference to the rotation regulating part;

a lid rotating and fastening means for relatively rotating the lid body and the vial body;

a lid placing part configured to rotatably place the lid body;

a rotation preventing member configured to contact the rotation regulating part in a predetermined rotation position; and a rotating and positioning means for rotating the lid body with a torque of a predetermined range.

19. A medicine accommodating and removing device, comprising:

a vial body accommodating section configured to accommodate vial bodies of vials;

a medicine stocking section configured to stock different kinds of medicines;

a medicine dispensing means configured to dispense a desired medicine out of the medicine stocking section; and lid fastening device according to claim 13, wherein the vial has the vial body and a lid body and includes threads engaging each other at the vial body and the lid body, the lid body including a rotation regulating part engaging a portion of the vial body to regulate rotation, and wherein the vial lid fastening device mounts the lid body to the vial body and comprises:

a vial body holding means for holding the vial body while maintaining a position in a rotation direction relative to a central axis;

a lid holding means for bringing the lid body into contact with the vial body while maintaining a position in a rotation direction relative to the central axis with reference to the rotation regulating part;

a lid rotating and fastening means for relatively rotating the lid body and the vial body;

a first lid body reservoir configured to stock the lid body;

a second lid body reservoir in a middle of a conveyance path wherein the lid body is conveyed from the first lid body reservoir to a predetermined location;

a first conveyor for conveying the lid body from the first lid body reservoir to the second lid body reservoir; and a second conveyor for conveying the lid body from the second lid body reservoir to the predetermined location, wherein the first conveyor is configured to remove the lid body out of the first conveyor and convey the lid body one by one and the second conveyor is configured to adjust an inside and outside position of the lid body and convey the lid body to the predetermined location.

20. A vial lid fastening device for a vial having a vial body and a lid body, the vial including threads engaging each other at the vial body and the lid body, the lid body including a rotation regulating part engaging a portion of the vial body to regulate rotation, the vial lid fastening device relatively rotating the lid body and the vial body relative to a central axis to fasten the lid body to the vial body, the vial lid fastening device comprising:

a lid holding means for bringing the lid body into contact with the vial body while determining and fixing a position in a rotation direction relative to the central axis with reference to the rotation regulating part;

a vial body holding means for holding the vial body while determining and fixing a position in a rotation direction relative to the central axis with reference to the portion of the vial body; and a lid rotating and fastening means for relatively rotating the lid body and the vial body, wherein the vial body holding means determines the position in a rotation direction of the vial body such that a beginning end of the thread of the lid body and a beginning end of the thread of the vial body contact each other at a rotation angle of less than 15 degrees.

* * * * *